US008648782B2

(12) United States Patent
Honda

(10) Patent No.: US 8,648,782 B2
(45) Date of Patent: Feb. 11, 2014

(54) DISPLAY DEVICE

(75) Inventor: Tatsuya Honda, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 831 days.

(21) Appl. No.: 12/251,664

(22) Filed: Oct. 15, 2008

(65) Prior Publication Data

US 2009/0102752 A1 Apr. 23, 2009

(30) Foreign Application Priority Data

Oct. 22, 2007 (JP) ..... 2007-274141

(51) Int. Cl.
*G09G 3/36* (2006.01)

(52) U.S. Cl.
USPC ..... 345/92; 345/50; 345/51; 345/52; 345/95

(58) Field of Classification Search
USPC ..... 345/55, 87, 90, 92, 95
See application file for complete search history.

(56) References Cited

U.S. PATENT DOCUMENTS

| | | | | |
|---|---|---|---|---|
| 5,686,932 | A | 11/1997 | Tomita | |
| 5,764,321 | A | 6/1998 | Koyama et al. | |
| 6,636,191 | B2 * | 10/2003 | Cok | 345/82 |
| 6,952,244 | B2 | 10/2005 | Cairns et al. | |
| 7,212,183 | B2 * | 5/2007 | Tobita | 345/93 |
| 2001/0019327 | A1 | 9/2001 | Kim et al. | |
| 2002/0047822 | A1 | 4/2002 | Senda et al. | |
| 2002/0196208 | A1 | 12/2002 | Nanno et al. | |
| 2006/0284811 | A1 * | 12/2006 | Huang | 345/92 |
| 2008/0001857 | A1 * | 1/2008 | Yoo | 345/76 |
| 2008/0170022 | A1 * | 7/2008 | Chen et al. | 345/92 |
| 2008/0284701 | A1 * | 11/2008 | Fan-Chiang et al. | 345/90 |
| 2009/0040150 | A1 * | 2/2009 | Senda | 345/76 |
| 2009/0051641 | A1 * | 2/2009 | Irie et al. | 345/96 |

FOREIGN PATENT DOCUMENTS

| | | | |
|---|---|---|---|
| CN | 1372242 | A | 10/2002 |
| EP | 1 239 323 | A1 | 9/2002 |
| JP | 5-210115 | | 8/1993 |
| JP | 5-216442 | | 8/1993 |
| JP | 10-161084 | | 6/1998 |
| JP | 2001-282205 | | 10/2001 |
| JP | 2002-333870 | | 11/2002 |
| JP | 2005-164891 | | 6/2005 |
| JP | 2006-10897 | | 1/2006 |

OTHER PUBLICATIONS

Office Action re Chinese application No. CN 200810170629.5, dated Jul. 22, 2011 (with English translation).

* cited by examiner

*Primary Examiner* — William Boddie
*Assistant Examiner* — Sahlu Okebato
(74) *Attorney, Agent, or Firm* — Husch Blackwell LLP

(57) ABSTRACT

The display device includes a signal line and a pixel. The pixel includes a first switching element, a capacitor having a first electrode which is electrically connected to the signal line through the first switching element, a display element electrically connected to the first electrode of the capacitor, a second switching element, and an electric charge supply terminal electrically connected to a second electrode of the capacitor through the second switching element. A potential difference between a potential of the signal line and a potential of the electric charge supply line is applied to the capacitor. Voltage of the capacitor at the time of writing is set higher than that of the display element. Accordingly, drop in voltage held in the capacitor due to degradation of the first switching element is reduced, and desired voltage applied to the display element is maintained.

12 Claims, 24 Drawing Sheets

DISPLAY DEVICE

BACKGROUND OF THE INVENTION

1. Field of the Invention

The present invention relates to a display device. Further, the present invention relates to an electronic device including the display device in a display portion.

2. Description of the Related Art

In recent years, as display devices such as a liquid crystal display device and an EL (electroluminescence) display device, an active matrix driving display device which includes thin film transistors (TFTs) in each pixel for higher definition is used in many cases. In an active matrix driving display device, a potential of a pixel electrode in each pixel can be independently controlled and thus, there is no crosstalk such as leakage of electric charge to an adjacent pixel, as in the case of a passive matrix driving display device in which pixels are controlled per line. Accordingly, a display device with little unevenness of display image and a higher contrast ratio can be manufactured.

As an example of a conventional active matrix display device, a structure and an operation of a pixel portion in a liquid crystal display device are described with reference to FIG. 24. FIG. 24 is a circuit diagram illustrating a structure of a conventional display device.

As illustrated in FIG. 24, the conventional display device includes a scanning line 700, a signal line 701, and a pixel. The pixel includes a switching transistor 702, a storage capacitor 703, and a capacitor of liquid crystal 704. The switching transistor 702 has a gate terminal, a source terminal, and a drain terminal. The gate terminal of the switching transistor 702 is electrically connected to the scanning line 700, and one of the source terminal and the drain terminal of the switching transistor 702 is electrically connected to the signal line 701. A first electrode of the storage capacitor 703 and a first electrode of the capacitor of liquid crystal 704 are electrically connected to the other of the source terminal and the drain terminal of the switching transistor 702.

Next, the operation of the conventional display device is described. At the time of writing a video signal, a signal is inputted from the scanning line 700 to the gate terminal of the switching transistor 702. When voltage applied between the gate and the source of the switching transistor 702 is equal to or higher than the threshold voltage of the switching transistor 702, the switching transistor 702 is an on state, and the video signal is inputted from the signal line 701 to the first electrode of the storage capacitor 703 and the first electrode of the capacitor of liquid crystal 704 through the switching transistor 702. In each of the storage capacitor 703 and the capacitor of liquid crystal 704 having the first electrode to which the video signal has been inputted, a potential of a second electrode is set in response to a signal from the outside, and thus a potential difference (voltage) between the potential of the first electrode and the potential of the second electrode is applied to the storage capacitor 703 and the capacitor of liquid crystal 704. In the capacitor of liquid crystal 704, liquid crystal molecules are controlled in accordance with the applied voltage, and display is performed.

An example of a method for driving the above display device includes frame inversion driving. In frame inversion driving, a signal whose polarity is inverted from a polarity of a signal inputted in one frame period is inputted to a capacitor of liquid crystal in the next frame period in order to prevent burn-in of the liquid crystal. For frame inversion, voltage twice as high as the writing voltage is applied between the source and the drain of the switching transistor 702. Thus, a high electric field is generated at the drain edge of the switching transistor 702, and carriers (hot carriers) accelerated by the high electric field degrades the transistor, resulting in increase in off-current and change in threshold voltage of the transistor.

When the off-current is increased due to degradation of the switching transistor, electric charge leaks from the storage capacitor 703 and the capacitor of liquid crystal 704 even if the switching transistor 702 is an off state (is in a period to hold a potential applied to the storage capacitor 703 and the capacitor of liquid crystal 704), and voltage applied to the liquid crystal becomes lower than a desired value. Accordingly, unevenness of display image occurs.

As an example of a technique for suppressing reduction in voltage of either of the capacitor of liquid crystal or the storage capacitor which is due to change in switching characteristics of the switching transistor in each pixel in the above liquid crystal display device, there is a structure in which a voltage control circuit electrically connected to the common electrode side of either of the capacitor of liquid crystal or the storage capacitor is provided (see Patent Document 1: Japanese Published Patent Application No. H5-216442).

In Patent Document 1, electric charge is compensated through the common electrode of a storage capacitor so as to adjust a potential of another electrode of the storage capacitor in accordance with change in switching characteristics of a switching transistor in each pixel, so that voltage applied to the storage capacitor is maintained at a predetermined value.

In an active matrix driving display device such as the above liquid crystal display device, since voltage held in a capacitor is changed from a predetermined value due to change in switching characteristics of a switching element or the like and thus, display image varies among pixels, a variety of circuits for suppressing change in voltage have been suggested.

SUMMARY OF TIE INVENTION

However, there is a problem in conventional art in that electric charge is compensated in response to reduction in voltage due to leakage of electric charge in the capacitor and thus, leakage of electric charge itself is not reduced.

In view of the foregoing problem, an object of the present invention is to reduce leakage of electric charge in a capacitor in a display device.

According to one aspect of the present invention, a display device including a pixel includes a display element provided in a pixel, a capacitor for holding the same voltage as a voltage applied to the display element, an electric charge supply element electrically connected to a first electrode of the capacitor, and a switching element. Voltage corresponding to image data is applied to the display element. By providing the switching element between the electric charge supply element and the capacitor, leakage of electric charge stored in the capacitor is suppressed.

Specifically, one aspect of the present invention is a display device including a signal line and a pixel. The pixel includes a first switching element, a capacitor, a display element, a second switching element, and an electric charge supply terminal. A first electrode of the capacitor is electrically connected to the signal line through the first switching element. The display element is electrically connected to the first electrode of the capacitor. The electric charge supply terminal is electrically connected to a second electrode of the capacitor through the second switching element.

Another aspect of the present invention is a display device including a signal line, a scanning line, and a pixel. The pixel includes a first transistor, a first capacitor, a second capacitor, a second transistor, and an electric charge supply terminal. A gate terminal of the first transistor is electrically connected to the scanning line. One of a source terminal and a drain terminal of the first transistor is electrically connected to the signal line. A first electrode of the first capacitor is electrically connected to the other of the source terminal and the drain terminal of the first transistor. A first electrode of the second capacitor is electrically connected to the first electrode of the first capacitor. A gate terminal of the second transistor is electrically connected to the scanning line. One of a source terminal and a drain terminal of the second transistor is electrically connected to a second electrode of the first capacitor The other of the source terminal and the drain terminal of the second transistor is electrically connected to the electric charge supply terminal.

Another aspect of the present invention is a display device including a signal line, a first scanning line, a second scanning line, and a pixel. The pixel includes a first transistor, a first capacitor, a second capacitor, a second transistor, and an electric charge supply terminal. A gate terminal of the first transistor is electrically connected to the first scanning line. One of a source terminal and a drain terminal of the first transistor is electrically connected to the signal line. A first electrode of the first capacitor is electrically connected to the other of the source terminal and the drain terminal of the first transistor. A first electrode of the second capacitor is electrically connected to the first electrode of the first capacitor. A gate terminal of the second transistor is electrically connected to the second scanning line. One of a source terminal and a drain terminal of the second transistor is electrically connected to a second electrode of the first capacitor. The other of the source terminal and the drain terminal of the second transistor is electrically connected to the electric charge supply terminal.

Another aspect of the present invention is a display device including a pixel portion, a signal line, a scanning line, a scanning line driver circuit electrically connected to the scanning line, a signal line driver circuit electrically connected to the signal line, and a control circuit which is electrically connected to the scanning line driver circuit and the signal line driver circuit and outputs a control signal to the scanning line driver circuit and the signal line driver circuit. The pixel portion includes a plurality of pixels each including a first transistor, a first capacitor, a second capacitor, a second transistor, and an electric charge supply terminal. A gate terminal of the first transistor is electrically connected to the scanning line. One of a source terminal and a drain terminal of the first transistor is electrically connected to the signal line. A first electrode of the first capacitor is electrically connected to the other of the source terminal and the drain terminal of the first transistor. A first electrode of the second capacitor is electrically connected to the first electrode of the first capacitor. A gate terminal of the second transistor is electrically connected to the scanning line. One of a source terminal and a drain terminal of the second transistor is electrically connected to a second electrode of the first capacitor. The other of the source terminal and the drain terminal of the second transistor is electrically connected to the electric charge supply terminal.

Another aspect of the present invention is a display device including a pixel portion, a signal line, a first scanning line, a second scanning line, a scanning line driver circuit electrically connected to the first scanning line and the second scanning line, a signal line driver circuit electrically connected to the signal line, and a control circuit which is electrically connected to the scanning line driver circuit and the signal line driver circuit and outputs a control signal to the scanning line driver circuit and the signal line driver circuit. The pixel portion includes a plurality of pixels each including a first transistor, a first capacitor, a second capacitor, a second transistor, and an electric charge supply terminal. A gate terminal of the first transistor is electrically connected to the first scanning line. One of a source terminal and a drain terminal of the first transistor is electrically connected to the signal line. A first electrode of the first capacitor is electrically connected to the other of the source terminal and the drain terminal of the first transistor. A first electrode of the second capacitor is electrically connected to the first electrode of the first capacitor. A gate terminal of the second transistor is electrically connected to the second scanning line. One of a source terminal and a drain terminal of the second transistor is electrically connected to a second electrode of the first capacitor. The other of the source terminal and the drain terminal of the second transistor is electrically connected to the electric charge supply terminal.

Still another aspect of the present invention is a display device including a pixel portion, a signal line, a scanning line, a scanning line driver circuit electrically connected to the scanning line, a signal line driver circuit electrically connected to the signal line, and a control circuit which is electrically connected to the scanning line driver circuit and the signal line driver circuit and outputs a control signal to the scanning line driver circuit and the signal line driver circuit. The pixel portion includes a plurality of pixels each including a first transistor, a first capacitor, and a second capacitor; a second transistor; and an electric charge supply terminal. A gate terminal of the first transistor is electrically connected to the scanning line. One of a source terminal and a drain terminal of the first transistor is electrically connected to the signal line. A first electrode of the first capacitor is electrically connected to the other of the source terminal and the drain terminal of the first transistor. A first electrode of the second capacitor is electrically connected to the first electrode of the first capacitor. A gate terminal of the second transistor is electrically connected to the scanning line. One of a source terminal and a drain terminal of the second transistor is electrically connected to a second electrode of the first capacitor in each of the plurality of pixels. The other of the source terminal and the drain terminal of the second transistor is electrically connected to the electric charge supply terminal.

Still another aspect of the present invention is a display device including a pixel portion, a signal line, a first scanning line, a second scanning line, a scanning line driver circuit electrically connected to the first scanning line and the second scanning line, a signal line driver circuit electrically connected to the signal line, and a control circuit which is electrically connected to the scanning line driver circuit and the signal line driver circuit and outputs a control signal to the scanning line driver circuit and the signal line driver circuit. The pixel portion includes a plurality of pixels each including a first transistor, a first capacitor, and a second capacitor; a second transistor; and an electric charge supply terminal. A gate terminal of the first transistor is electrically connected to the first scanning line. One of a source terminal and a drain terminal of the first transistor is electrically connected to the signal line. A first electrode of the first capacitor is electrically connected to the other of the source terminal and the drain terminal of the first transistor. A first electrode of the second capacitor is electrically connected to the first electrode of the first capacitor. A gate terminal of the second transistor is electrically connected to the second scanning line. One of a source terminal and a drain terminal of the second transistor is electrically connected to a second electrode of the first capacitor in each of the plurality of pixels. The other of the source terminal and the drain terminal of the second transistor is electrically connected to the electric charge supply terminal.

Still another aspect of the present invention is a display device including a signal line, a power supply line, a scanning line, and a pixel. The pixel includes a first transistor, a capacitor, a second transistor, an electric charge supply terminal, a third transistor, and a light-emitting element. A gate terminal of the first transistor is electrically connected to the scanning line. One of a source terminal and a drain terminal of the first transistor is electrically connected to the signal line. A first electrode of the capacitor is electrically connected to the other of the source terminal and the drain terminal of the first transistor. A gate terminal of the second transistor is electrically connected to the other of the source terminal and the drain terminal of the first transistor. One of a source terminal and a drain terminal of the second transistor is electrically connected to the power supply line. A first electrode of the light-emitting element is electrically connected to the other of the source terminal and the drain terminal of the second transistor. A gate terminal of the third transistor is electrically connected to the scanning line. One of a source terminal and a drain terminal of the third transistor is electrically connected to a second electrode of the capacitor. The other of the source terminal and the drain terminal of the third transistor is electrically connected to the electric charge supply terminal.

Another aspect of the present invention is a display device including a signal line, a power supply line, a first scanning line, a second scanning line, and a pixel. The pixel includes a first transistor, a capacitor, a second transistor, a light-emitting element, a third transistor, and an electric charge supply terminal. A gate terminal of the first transistor is electrically connected to the first scanning line. One of a source terminal and a drain terminal of the first transistor is electrically connected to the signal line. A first electrode of the capacitor is electrically connected to the other of the source terminal and the drain terminal of the first transistor. A gate terminal of the second transistor is electrically connected to the other of the source terminal and the drain terminal of the first transistor. One of a source terminal and a drain terminal of the second transistor is electrically connected to the power supply line. A first electrode of the light-emitting element is electrically connected to the other of the source terminal and the drain terminal of the second transistor. A gate terminal of the third transistor is electrically connected to the second scanning line. One of a source terminal and a drain terminal of the third transistor is electrically connected to a second electrode of the capacitor. The other of the source terminal and the drain terminal of the third transistor is electrically connected to the electric charge supply terminal.

Another aspect of the present invention is a display device including a pixel portion, a signal line, a power supply line, a scanning line, a scanning line driver circuit electrically connected to the scanning line, a signal line driver circuit electrically connected to the signal line and the power supply line, and a control circuit which is electrically connected to the scanning line driver circuit and the signal line driver circuit and outputs a control signal to the scanning line driver circuit and the signal line driver circuit. The pixel portion includes a plurality of pixels each including a first transistor, a capacitor, a second transistor, a light-emitting element, a third transistor, and an electric charge supply terminal. A gate terminal of the first transistor is electrically connected to the scanning line. One of a source terminal and a drain terminal of the first transistor is electrically connected to the signal line. A first electrode of the capacitor is electrically connected to the other of the source terminal and the drain terminal of the first transistor. A gate terminal of the second transistor is electrically connected to the other of the source terminal and the drain terminal of the first transistor. One of a source terminal and a drain terminal of the second transistor is electrically connected to the power supply line. A first electrode of the light-emitting element is electrically connected to the other of the source terminal and the drain terminal of the second transistor. A gate terminal of the third transistor is electrically connected to the scanning line. One of a source terminal and a drain terminal of the third transistor is electrically connected to a second electrode of the capacitor. The other of the source terminal and the drain terminal of the third transistor is electrically connected to the electric charge supply terminal.

Another aspect of the present invention is a display device including a pixel portion, a signal line, a power supply line, a first scanning line, a second scanning line, a scanning line driver circuit electrically connected to the first scanning line and the second scanning line, a signal line driver circuit electrically connected to the signal line and the power supply line, and a control circuit which is electrically connected to the scanning line driver circuit and the signal line driver circuit and outputs a control signal to the scanning line driver circuit and the signal line driver circuit. The pixel portion includes a plurality of pixels each including a first transistor, a capacitor, a second transistor, a light-emitting element, a third transistor, and an electric charge supply terminal. A gate terminal of the first transistor is electrically connected to the first scanning line. One of a source terminal and a drain terminal of the first transistor is electrically connected to the signal line. A first electrode of the capacitor is electrically connected to the other of the source terminal and the drain terminal of the first transistor. A gate terminal of the second transistor is electrically connected to the other of the source terminal and the drain terminal of the first transistor. One of a source terminal and a drain terminal of the second transistor is electrically connected to the power supply line. A first electrode of the light-emitting element is electrically connected to the other of the source terminal and the drain terminal of the second transistor. A gate terminal of the third transistor is electrically connected to the second scanning line. One of a source terminal and a drain terminal of the third transistor is electrically connected to a second electrode of the capacitor. The other of the source terminal and the drain terminal of the third transistor is electrically connected to the electric charge supply terminal.

Another aspect of the present invention is a display device including a pixel portion, a signal line, a power supply line, a scanning line, a scanning line driver circuit electrically connected to the scanning line, a signal line driver circuit electrically connected to the signal line and the power supply line, and a control circuit which is electrically connected to the scanning line driver circuit and the signal line driver circuit and outputs a control signal to the scanning line driver circuit and the signal line driver circuit. THE pixel portion includes a plurality of pixels each including a first transistor, a capacitor, a second transistor, and a light-emitting element; a third transistor; and an electric charge supply terminal. A gate terminal of the first transistor is electrically connected to the scanning line. One of a source terminal and a drain terminal of the first transistor is electrically connected to the signal line. A first electrode of the capacitor is electrically connected to the other of the source terminal and the drain terminal of the first transistor. A gate terminal of the second transistor is electrically connected to the other of the source terminal and the drain terminal of the first transistor. One of a source terminal and a drain terminal of the second transistor is electrically connected to the power supply line. A first electrode of the light-emitting element is electrically connected to the other of the source terminal and the drain terminal of the second transistor. A gate terminal of the third transistor is electrically connected to the scanning line. One of a source terminal and a drain terminal of the third transistor is electrically connected to a second electrode of the capacitor in each of the plurality of pixels. The other of the source terminal and the drain terminal of the third transistor is electrically connected to the electric charge supply terminal.

Still another aspect of the present invention is a display device including a pixel portion, a signal line, a power supply line, a first scanning line, a second scanning line, a scanning line driver circuit electrically connected to the first scanning line and the second scanning line, a signal line driver circuit electrically connected to the signal line and the power supply line, and a control circuit which is electrically connected to the scanning line driver circuit and the signal line driver circuit and outputs a control signal to the scanning line driver circuit and the signal line driver circuit. The pixel portion includes a plurality of pixels each including a first transistor, a capacitor, a second transistor, and a light-emitting element; a third transistor; and an electric charge supply terminal. A gate terminal of the first transistor is electrically connected to the first scanning line. One of a source terminal and a drain terminal of the first transistor is electrically connected to the signal line. A first electrode of the capacitor is electrically connected to the other of the source terminal and the drain terminal of the first transistor. A gate terminal of the second transistor is electrically connected to the other of the source terminal and the drain terminal of the first transistor One of a source terminal and a drain terminal of the second transistor is electrically connected to the power supply line. A first electrode of the light-emitting element is electrically connected to the other of the source terminal and the drain terminal of the second transistor. A gate terminal of the third transistor is electrically connected to the second scanning line. One of a source terminal and a drain terminal of the third transistor is electrically connected to a second electrode of the capacitor in each of the plurality of pixels. The other of the source terminal and the drain terminal of the third transistor is electrically connected to the electric charge supply terminal.

Still another aspect of the present invention is an electronic device including one of the above display devices in a display portion.

Note that a transistor in this document (the specification, the claims, the drawings, or the like) has at least three terminals of a gate terminal, a drain terminal, and a source terminal. The gate terminal refers to part of a gate electrode (including a region to serve as a gate, a conductive film, a wiring, and the like) or part of a portion which is electrically connected to the gate electrode. The source terminal refers to part of a source electrode (including a region to serve as a source, a conductive film, a wiring, and the like) or part of a portion which is electrically connected to the source electrode. The drain terminal refers to part of a drain electrode (including a region to serve as a drain, a conductive film, a wiring, and the like) or part of a portion which is electrically connected to the drain electrode.

Since the source terminal and the drain terminal of the transistor in this document (the specification, the claims, the drawings, or the like) are changed depending on the structure, the operating conditions, or the like of the transistor, it is difficult to define which is a source terminal and which is a drain terminal. Therefore, in this document (the specification, the claims, the drawings, or the like), one terminal is referred to as one of the source terminal and the drain terminal, and the other terminal is referred to as the other of the source terminal and the drain terminal.

In addition, a capacitor and a light-emitting element in this document (the specification, the claims, the drawings, or the like) each have at least two electrodes of one electrode and the other electrode. The entire or part of one electrode is referred to as a first electrode, and the entire or part of the other electrode is referred to as a second electrode.

According to the present invention, leakage of electric charge of a capacitor in a pixel of a display device can be reduced.

DETAILED DESCRIPTION OF THE INVENTION

Hereinafter, embodiment modes of the present invention will be described with reference to the accompanying drawings. Note that the present invention is not limited to the following description, and it is easily understood by those skilled in the art that modes and details can be variously changed without departing from the spirit and the scope of the present invention. Therefore, the present invention is not construed as being limited to the description of the embodiment modes described below.

Embodiment Mode 1

In this embodiment mode, an example of a display device of the present invention is described.

Figure 1:
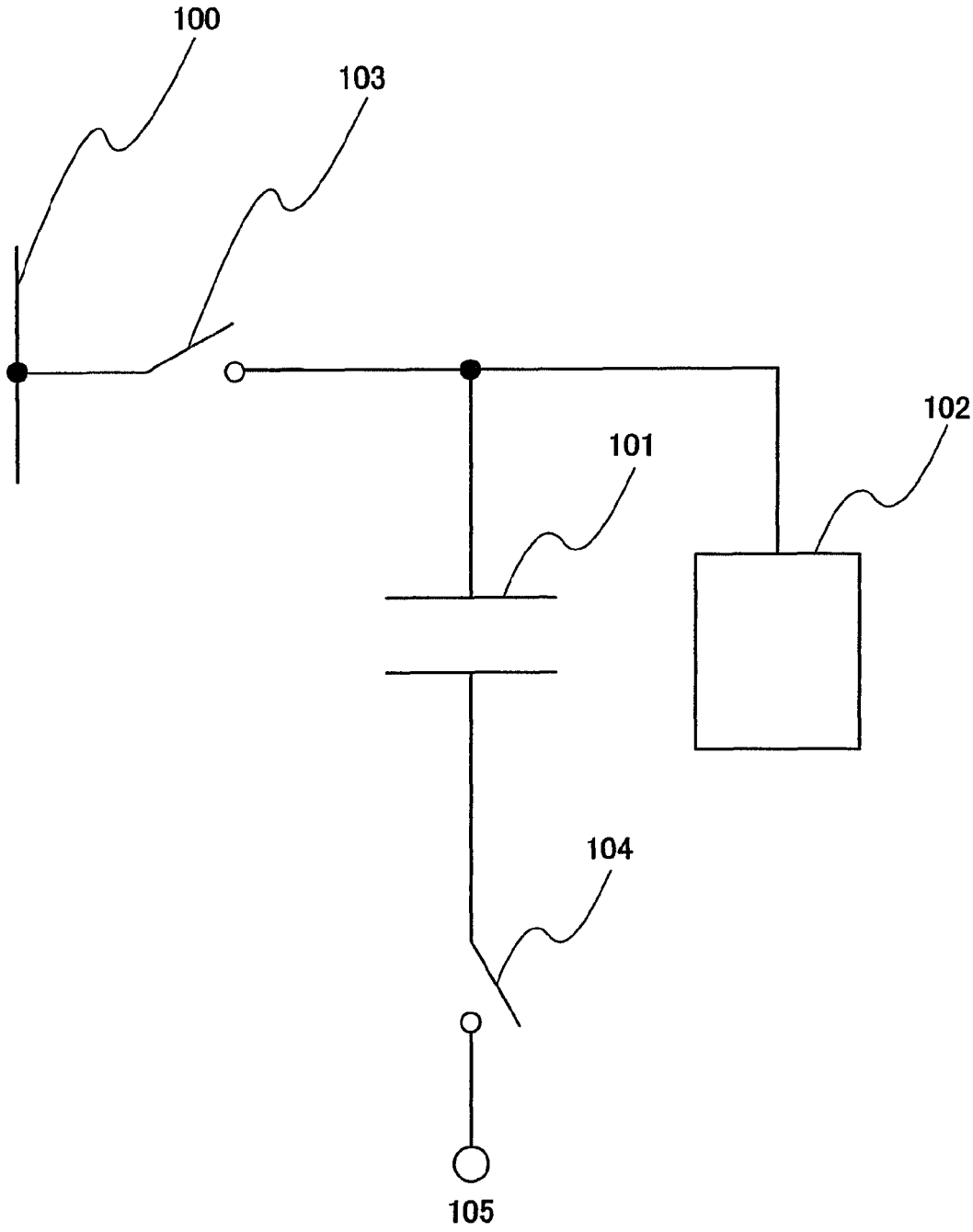
FIG. 1 is a circuit diagram illustrating a structure of a display device of the present invention in Embodiment Mode 1.

A structure of a display device in this embodiment mode is described with reference to FIG. 1. FIG. 1 is a circuit diagram illustrating a schematic structure of the display device in this embodiment mode.

As illustrated in FIG. 1, the display device in this embodiment mode includes a signal line 100 and a pixel. The pixel includes a first switching element 103, a capacitor 101 having a first electrode which is electrically connected to the signal line 100 through the first switching element 103, a display element 102 which is electrically connected to the first electrode of the capacitor 101, a second switching element 104, and an electric charge supply terminal 105 which is electrically connected to a second electrode of the capacitor 101 through the second switching element 104.

The first switching element 103 is turned on or off as selected to control input of a video signal conducted from the signal line 100 to the capacitor 101 and the display element 102.

The display element 102 has a function of displaying an image in accordance with applied voltage to the display element 102 by input of a video signal conducted from the signal line 100. Note that a display element such as a liquid crystal element or an EL element can be applied to the display element 102, for example.

The capacitor 101 has a function as a storage capacitor of the display element 102, compensates electric charge leaking from the electrode of the display element 102, and suppresses reduction of voltage applied to the display element 102 in the passage of time.

The second switching element 104 is turned on or off as selected to function as a potential control element which suppresses leakage of electric charge stored in the capacitor 101 in accordance with increase in off-current due to degradation of the first switching element 103.

Note that various types of switches, for example, an electrical switch and a mechanical switch can be used as the switching element. That is, any element can be used without being limited to a particular type as long as it can control a current flow. For example, a transistor (e.g., a bipolar transistor or a MOS transistor), a diode (e.g., a PN diode, a PIN diode, a Schottky diode, a metal-insulator-metal (MIM) diode, a metal-insulator-semiconductor (MIS) diode, or a diode-connected transistor), a thyristor, or the like can be used as the switching element. Alternatively, a logic circuit in which such elements are combined can be used as the switching element.

Examples of a mechanical switching element include a switching element formed using a micro electro mechanical system (MEMS) technology, such as a digital micromirror device (DMD). Such a switching element includes an electrode which can be moved mechanically, and operates by controlling connection or non-connection based on movement of the electrode.

The electric charge supply terminal 105 has a function of supplying electric charge to the capacitor 101 when the second switching element 104 is on. Note that the electric charge supply terminal 105 can be grounded. Alternatively, the electric charge supply terminal 105 can be electrically connected to a power supply line that is additionally provided.

Next, an operation in the pixel of FIG. 1 is described.

First, writing to the display element 102 is described. At the time of writing, the first switching element 103 and the second switching element 104 are turned on, whereby a signal potential corresponding to data is outputted from the signal line 100 to the capacitor 101 and the display element 102 through the first switching element 103, and voltage having a predetermined value is applied to the capacitor 101 and the display element 102.

Next, a holding of the display element 102 is described. At the time of a holding state, the first switching element 103 and the second switching element 104 are turned off, whereby the voltage applied to the capacitor 101 and the display element 102 is held.

At the time of writing, however, a high electric field is generated in the first switching element 103, so that the first switching element 103 degrades. When the first switching element 103 degrades, off-current of the switching element 103 is increased. Accordingly, electric charge leaks from the display element 102 through the first switching element 103. Moreover, electric charge is likely to leak from the first electrode of the capacitor 101 through the first switching element 103. When electric charge leaks from both the capacitor 101 and the display element 102, the capacitor 101 does not function as the storage capacitor of the display element 102 and cannot suppress a drop in voltage applied to the display element 102. However, since high voltage is not applied to the second switching element 104 at the time of writing, the second switching element 104 is less likely to degrade as compared to the first switching element 103, and increase in off-current or decrease in resistance of the second switching element 104 can be ignored. When a resistor large enough to ignore leakage of electric charge is added to the second electrode of the capacitor 101, electric charge in the first electrode of the capacitor 101 do not leak even if the first electrode of the capacitor 101 is almost electrically conductive. This is because in order that electric charge leaks from the first electrode, a corresponding amount of electric charge which leaks from the first electrode is necessarily supplied to the second electrode; however, the second switching element 104 is in an off state, of which resistance is high, and thus electric charge is not supplied from the electric charge supply terminal 105 to the second electrode of the capacitor 101.

As described above, leakage of electric charge of the capacitor 101 due to increase in off-current of the first switching element 103 can be reduced. Accordingly, electric charge is compensated from the capacitor 101 through the first switching element 103 so that predetermined voltage applied to the display element 102 can be maintained, and unevenness of display image (gray scale) can be reduced.

Embodiment Mode 2

In this embodiment mode, a liquid crystal display device is described as a specific example of the display device of the present invention.

Figure 2:
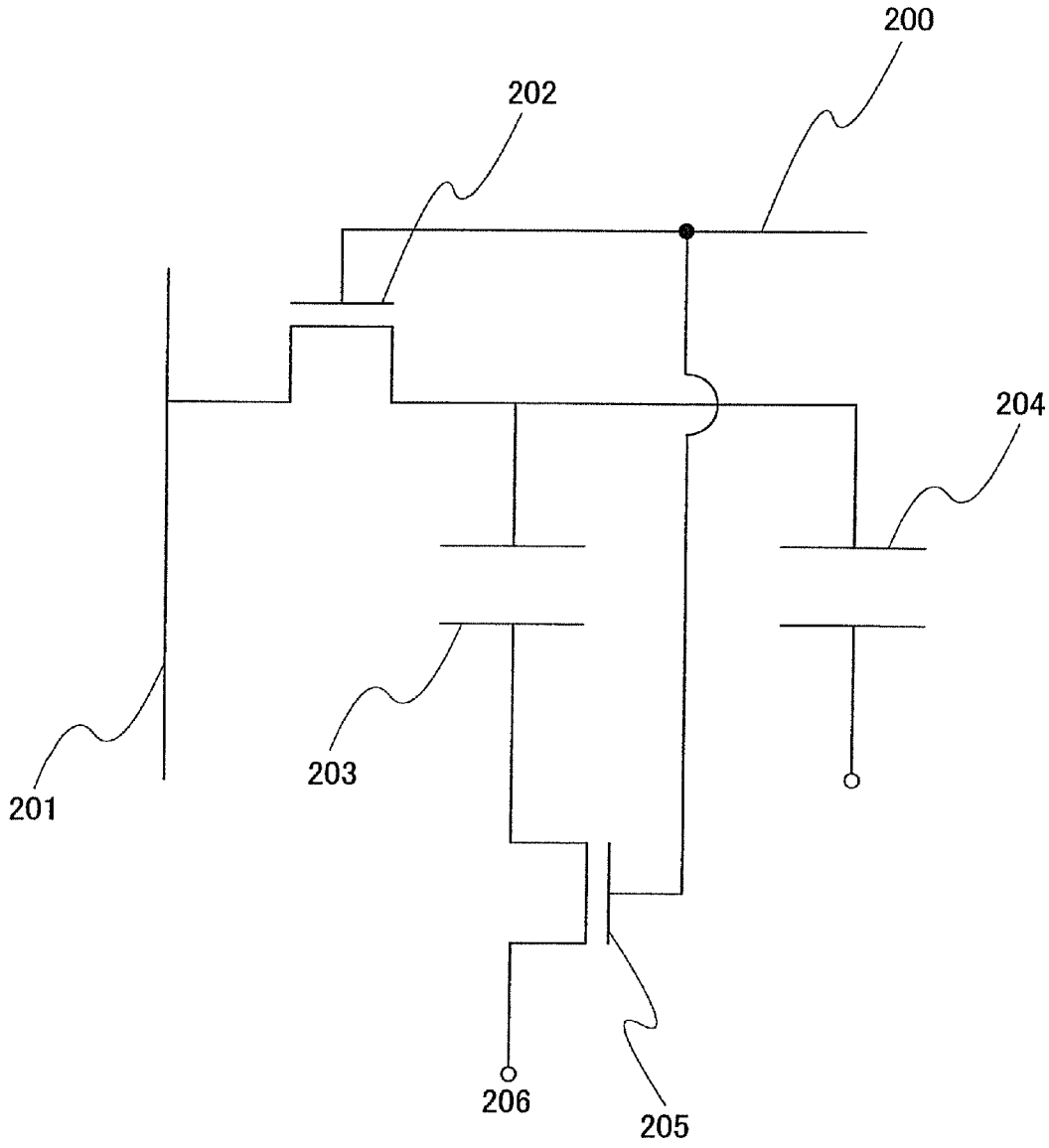
FIG. 2 is a circuit diagram illustrating a structure of a display device of the present invention in Embodiment Mode 2.

First, a structure of a display device in this embodiment mode is described with reference to FIG. 2. FIG. 2 is a circuit diagram illustrating a structure of the display device in this embodiment mode.

As illustrated in FIG. 2, the display device in this embodiment mode includes a scanning line 200, a signal line 201, and a pixel. The pixel includes a first transistor 202, a first capacitor 203, a second capacitor 204, a second transistor 205, and an electric charge supply terminal 206. A gate terminal of the first transistor 202 is electrically connected to the scanning line 200. One of a source terminal and a drain terminal of the first transistor 202 is electrically connected to the signal line 201. A first electrode of the first capacitor 203 is electrically connected to the other of the source terminal and the drain terminal of the first transistor 202. A first electrode of the second capacitor 204 is electrically connected to the first electrode of the first capacitor 203. A gate terminal of the second transistor 205 is electrically connected to the scanning line 200. One of a source terminal and a drain terminal of the second transistor 205 is electrically connected to a second electrode of the first capacitor 203. The electric charge supply terminal 206 is electrically connected to the other of the source terminal and the drain terminal of the second transistor 205.

The first transistor 202 functions as a switching element and is turned on or off in accordance with a signal potential inputted to the gate terminal from the scanning line 200.

The first capacitor 203 functions as a storage capacitor and has a function of compensating change of voltage stored in the second capacitor 204 in the passage of time. The second capacitor 204 includes the first electrode, a second electrode, and liquid crystal molecules. The second electrode of the second capacitor 204 is grounded or connected to a power supply separately. Moreover, the second capacitor 204 functions as a capacitor of liquid crystal. The first transistor 202 is turned on, whereby a video signal is inputted from the signal line 201 to the first capacitor 203 and the second capacitor 204 through the first transistor 202, electric charge is stored in the first capacitor 203 and the second capacitor 204, and voltage having a predetermined value is applied to the first capacitor 203 and the second capacitor 204. Further, the transmittance of the second capacitor 204 is changed in accordance with the held voltage. In the display device of the present invention, displaying an image is performed by setting the transmittance at a predetermined value per pixel.

The second transistor 205 functions as a switching element and is turned on or off in accordance with a signal potential inputted from the scanning line 200 to the gate terminal. The second transistor 205 is turned on, whereby electric charge is supplied from the electric charge supply terminal 206 to the second electrode of the first capacitor 203.

The electric charge supply terminal 206 has a function of supplying electric charge to the first capacitor 203 when the second transistor 205 is on. Note that the electric charge supply terminal 206 can be grounded. Alternatively, the electric charge supply terminal 206 can be electrically connected to a power supply line that is additionally provided.

Next, an operation of the display device with the structure of FIG. 2 is described.

First, writing to the first capacitor 203 and the second capacitor 204 is described. At the time of writing, by inputting a scanning signal from the scanning line 200 to the gate terminals of the first transistor 202 and the second transistor 205, the first transistor 202 and the second transistor 205 are turned on. The first transistor 202 is turned on, whereby a video signal is inputted from the signal line 201 to the first electrode of the first capacitor 203. Moreover, the second transistor 205 is turned on, whereby the second electrode of the first capacitor 203 is grounded. Therefore, voltage having a predetermined value is applied to the first capacitor 203 and the second capacitor 204 by input of a video signal.

Next, data holding of the first capacitor 203 and the second capacitor 204 is described. At the time of data holding, the first transistor 202 and the second transistor 205 are turned off, whereby voltage having a predetermined value is stored in the first capacitor 203 and the second capacitor 204.

At the time of writing, a high electric field is applied to the drain terminal of the first transistor 202, and hot carriers are generated. Accordingly, off-current of the first transistor 202 is increased due to hot carrier degradation, and electric charge is likely to leak from the first electrode of the first capacitor 203 due to increase in off-current of the first transistor 202. In the case where a resistor as large as channel resistance when a transistor is off is added to the second electrode of the first capacitor 203, electric charge in the first electrode does not leak even if the first electrode of the first capacitor 203 is electrically conductive. This is because in order that electric charge leaks from the first electrode of the first capacitor 203, a corresponding amount of electric charge which has leaked from the first electrode of the first capacitor 203 is necessarily supplied to the second electrode of the first capacitor 203; however, the second switching element 104 is off, and electric charge is not supplied from the electric charge supply terminal 206 to the second electrode of the first capacitor 203. At the time of writing, high voltage such as voltage applied between the source terminal and the drain terminal of the first transistor 202 is not applied between the source terminal and the drain terminal of the second transistor 205, and the second transistor 205 is less likely to degrade as compared to the first transistor 202, so that resistance in an off state of the second transistor 205 is higher than that of the first transistor 202. Accordingly, leakage of electric charge of the first capacitor 203 due to increase in off-current of the first transistor 202 can be reduced, and reduction in voltage held in the first capacitor 203 can be suppressed.

As described above, by providing the second transistor 205, leakage of electric charge of the first capacitor 203 due to increase in off-current of the first transistor 202 can be reduced, and the first capacitor 203 can compensate for reduction in voltage applied to the second capacitor 204 in the passage of time due to increase in off-current of the first transistor 202. Accordingly, unevenness of displaying an image (gray scale) due to change in transmittance of the pixel can be reduced.

Figure 3:
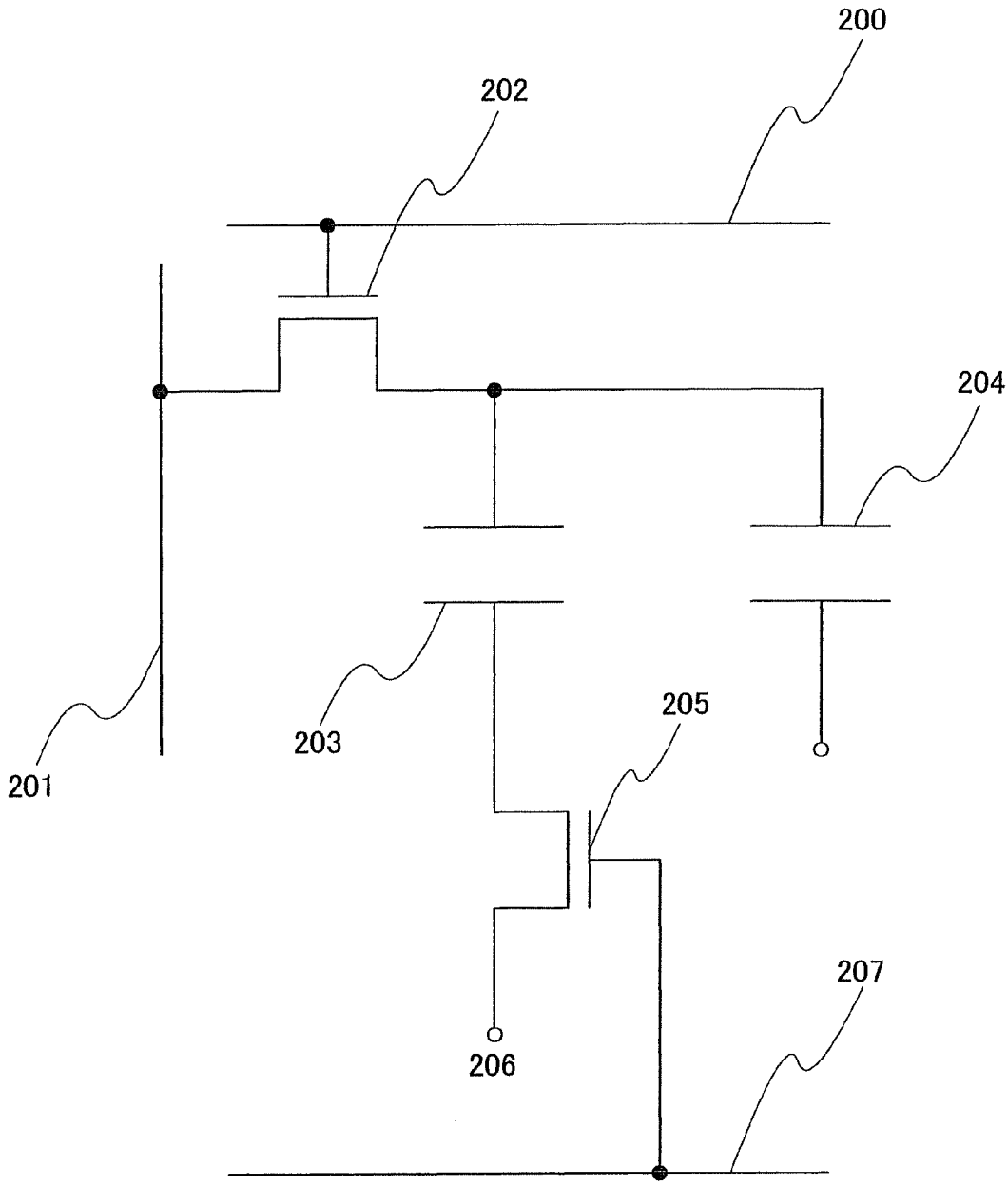
FIG. 3 is a circuit diagram illustrating a structure of a display device of the present invention in Embodiment Mode 2.

In addition, the structure of the display device in this embodiment mode can be applied not only to the above-described structure but also to other structures. Another structure example of the display device in this embodiment mode is described with reference to FIG. 3. FIG. 3 is a circuit diagram illustrating another structure example of the display device in this embodiment mode.

As illustrated in FIG. 3, the display device with another structure in this embodiment mode includes the first scanning line 200, a second scanning line 207, the signal line 201, and a pixel. The pixel includes the first transistor 202, the first capacitor 203, the second capacitor 204, the second transistor 205, and the electric charge supply terminal 206. The gate terminal of the first transistor 202 is electrically connected to the first scanning line 200. One of the source terminal and the drain terminal of the first transistor 202 is electrically connected to the signal line 201. The first electrode of the first capacitor 203 is electrically connected to the other of the source terminal and the drain terminal of the first transistor 202. The first electrode of the second capacitor 204 is electrically connected to the first electrode of the first capacitor 203. The gate terminal of the second transistor 205 is electrically connected to the second scanning line 207. One of the source terminal and the drain terminal of the second transistor 205 is electrically connected to the second electrode of the first capacitor 203. The electric charge supply terminal 206 is electrically connected to the other of the source terminal and the drain terminal of the second transistor 205.

The first transistor 202 functions as a switching element and is turned on or off in accordance with a signal potential inputted to the gate terminal from the first scanning line 200.

The first capacitor 203 has a function of compensating change of voltage stored in the second capacitor 204 in the passage of time, as a storage capacitor. The second capacitor 204 includes the first electrode, the second electrode, and the liquid crystal molecules. The second electrode of the second capacitor 204 is grounded or connected to a power supply separately. Moreover, the second capacitor 204 functions as a capacitor of liquid crystal. The first transistor 202 and the second transistor 205 are turned on, whereby a video signal is inputted from the signal line 201 to the first capacitor 203 and the second capacitor 204 through the first transistor 202. By input of the video signal, electric charge is stored in the first capacitor 203 and the second capacitor 204, and voltage is applied to the capacitors. The transmittance of the liquid crystal molecules in the second capacitor 204 is changed in accordance with the voltage held in the second capacitor 204, and displaying an image is performed at the predetermined transmittance.

The second transistor 205 functions as a switching element, is turned on or off in accordance with a signal potential inputted to the gate terminal from the second scanning line 207, and has a function of reducing leakage of electric charge of the first capacitor 203 due to increase in off-current of the first transistor 202. Note that the first transistor 202 and the second transistor 205 can have different conductivity.

The electric charge supply terminal 206 has a function of supplying electric charge to the first capacitor 203 when the second transistor 205 is on. Note that the electric charge supply terminal 206 can be grounded. Alternatively, the electric charge supply terminal 206 can be electrically connected to a power supply line that is additionally provided.

Next, an operation in the structure of FIG. 3 is described.

At the time of writing, a high electric field is applied to the drain terminal of the first transistor 202, and hot carriers are generated. Accordingly, off-current of the first transistor 202 is increased due to hot carrier degradation, and electric charge is likely to leak from the first electrode of the first capacitor 203. In the case where a resistor as large as channel resistance when a transistor is off is added to the second electrode of the first capacitor 203, electric charge in the first electrode do not leak even if the first electrode of the first capacitor 203 is electrically conductive. At the time of writing, high voltage such as voltage applied to the first transistor 202 is not applied to the second transistor 205, and the second transistor 205 is less likely to degrade as compared to the first transistor 202, so that resistance in an off state of the second transistor 205 is higher than that of the first transistor 202. Accordingly, leakage of electric charge of the first capacitor 203 due to increase in off-current of the first transistor 202 can be reduced, and reduction in voltage of the first capacitor 203 can be suppressed.

As described above, by electrically connecting two transistors in the pixel to different scanning lines, timing of the operation can be individually set. Moreover, flexibility in selecting design can be increased, for example, the first transistor and the second transistor may have different conductivity type.

Next, a specific structure of the above-described display device is described.

Figure 4:
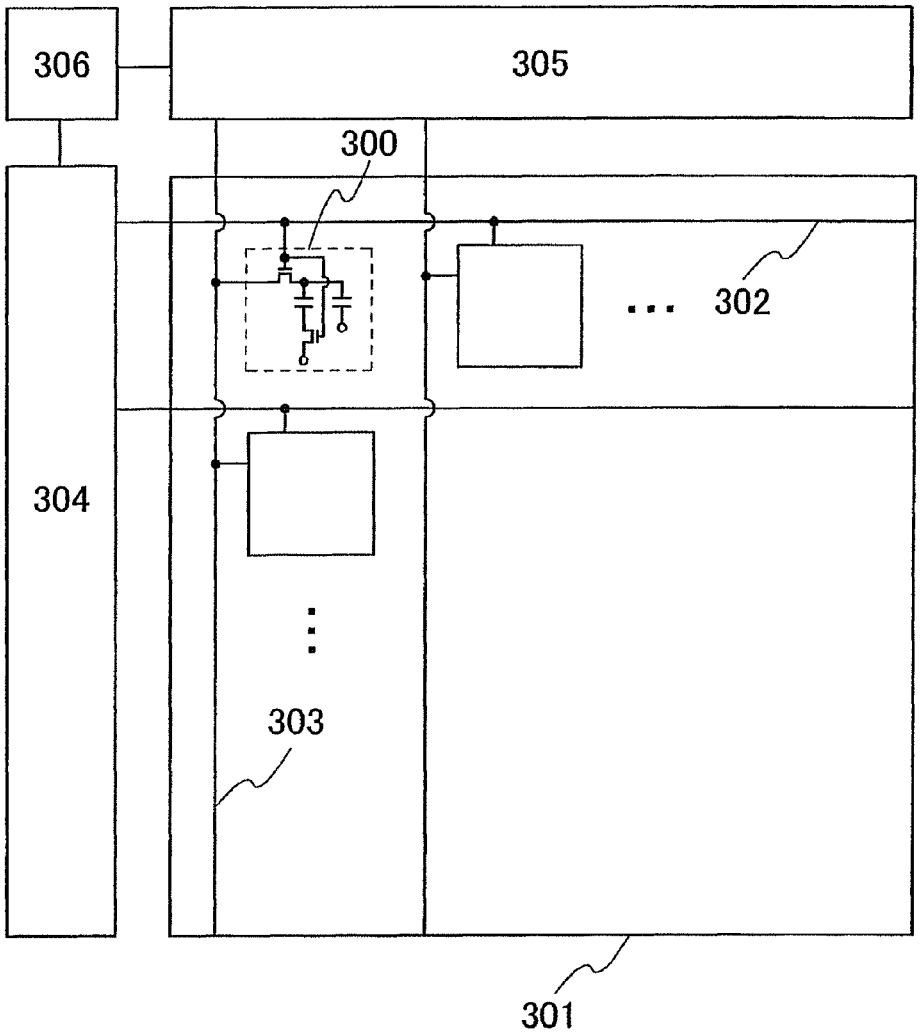
FIG. 4 is a circuit diagram illustrating a specific structure of a display device of the present invention in Embodiment Mode 2.

First, a specific structure of the display device illustrated in FIG. 2 is described with reference to FIG. 4. FIG. 4 is a circuit diagram illustrating an example of a specific structure of the display device of the present invention in this embodiment mode.

As illustrated in FIG. 4, the display device in this embodiment mode includes a pixel portion 301 including a plurality of pixels 300, a scanning line 302, a signal line 303, a scanning line driver circuit (a gate driver) 304 which is electrically connected to the scanning line 302, a signal line driver circuit (a source driver) 305 which is electrically connected to the signal line 303, and a control circuit 306 which is electrically connected to the scanning line driver circuit 304 and the signal line driver circuit 305.

The plurality of pixels 300 provided in the pixel portion 301 are arranged in matrix in intersection regions of the scanning lines 302 and the signal lines 303. A signal potential can be inputted individually to each pixel 300. Note that the pixel structure illustrated in FIG. 2 can be applied to the plurality of pixels 300 provided in the pixel portion 301. The scanning line 302 and the signal line 303 correspond to the scanning line 200 and the signal line 201 in FIG. 2.

Figure 5:
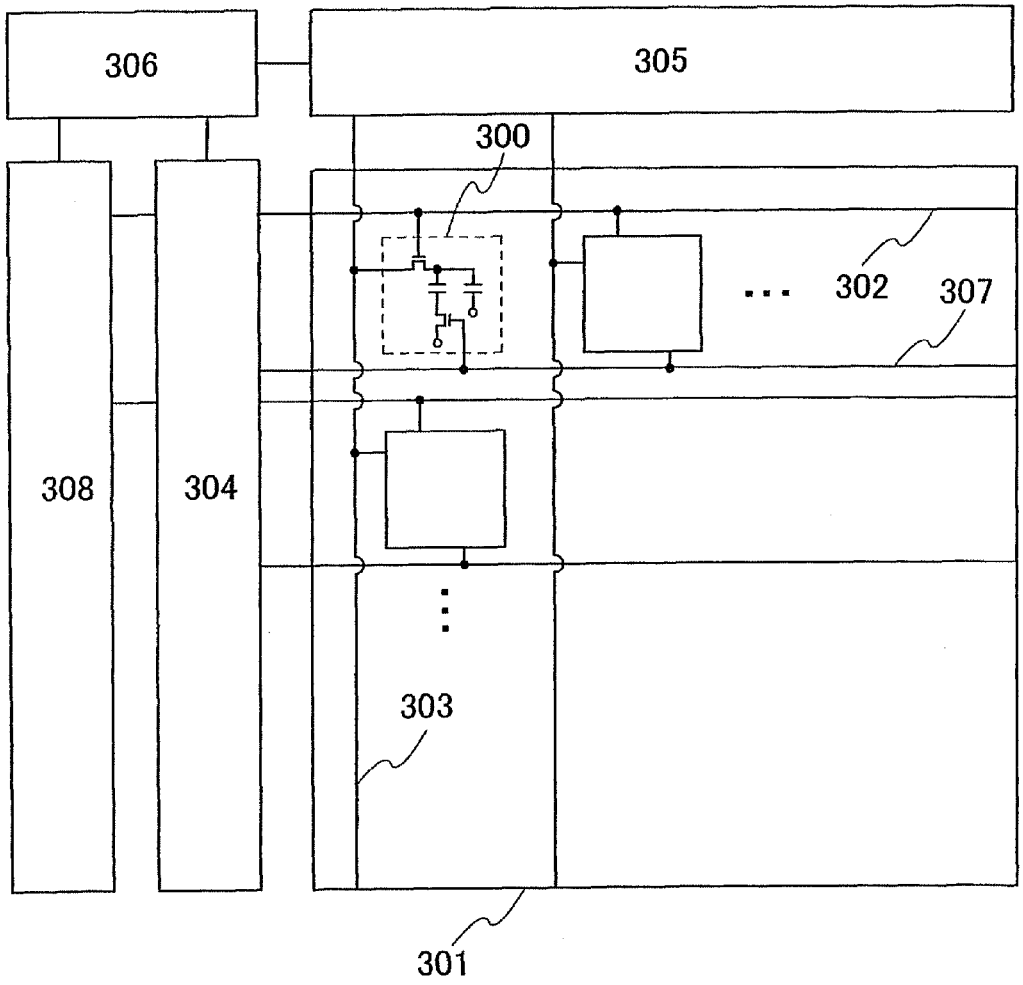
FIG. 5 is a circuit diagram illustrating another specific structure of a display device of the present invention in Embodiment Mode 2.

Alternatively, the structure illustrated in FIG. 3 can be applied. When the structure illustrated in FIG. 3 is applied, as illustrated in FIG. 5, a second scanning line 307 and a second scanning line driver circuit 308 are provided, and the first transistor 202 is controlled in accordance with a signal potential from the second scanning line driver circuit 308. Note that the second scanning line 307 corresponds to the second scanning line 207 in FIG. 3.

The control circuit 306 has a function of controlling the scanning line driver circuit 304 and the signal line driver circuit 305 in accordance with an inputted video signal. Specifically, the control circuit 306 outputs a control signal to each of the scanning line driver circuit 304 and the signal line driver circuit 305.

The scanning line driver circuit 304 has a function of outputting a scanning signal to the scanning line 302 in accordance with the control signal inputted from the control circuit 306.

The signal line driver circuit 305 has a function of outputting a video signal to the signal line 303 in accordance with the control signal inputted from the control circuit 306.

Note that the control circuit 306 can also have a structure including a power supply and a lighting unit. The power supply includes a unit which is controlled in accordance with a video signal and supplies power to the lighting unit. As the lighting unit, an edge-light type backlight unit or a direct-type backlight unit can be used. In addition, a front light may also be used as the lighting unit. A front light corresponds to a plate-like lighting unit including a luminous body and a light conducting body, which is attached to the front surface side of a pixel portion and illuminates the whole area. By using such a lighting unit, the pixel portion can be uniformly illuminated at low power consumption.

Although an example where the driver circuits are arranged on the left side and the upper side of the pixel portion 301 is illustrated in FIGS. 4 and 5, the positions of the driver circuits are not limited thereto, and the driver circuits can be provided at other positions. Moreover, in a structure including a plurality of driver circuits, the driver circuits can be arranged on the same side with respect to the pixel portion or arranged at different positions.

Next, examples of structures of a scanning line driver circuit and a signal line driver circuit of the display device in this embodiment mode are described.

Figure 6A:
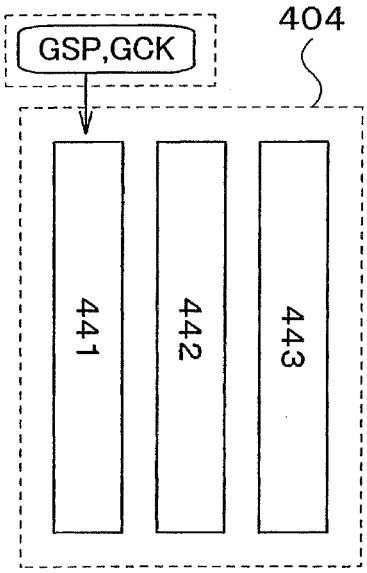
FIGS. 6A and 6B are each a block diagram illustrating a structure of a driver circuit in a display device of the present invention in Embodiment Mode 2.

First, an example of a structure of a scanning line driver circuit is described with reference to FIG. 6A. FIG. 6A is a block diagram illustrating an example of a structure of a scanning line driver circuit in a display device of this embodiment mode.

As illustrated in, FIG. 6A, a scanning line driver circuit 404 includes a shift register 441, a level shifter 442, and a buffer 443.

Signals such as a gate start pulse (GSP) and a gate clock signal (GCK) are inputted to the shift register 441.

Figure 6B:
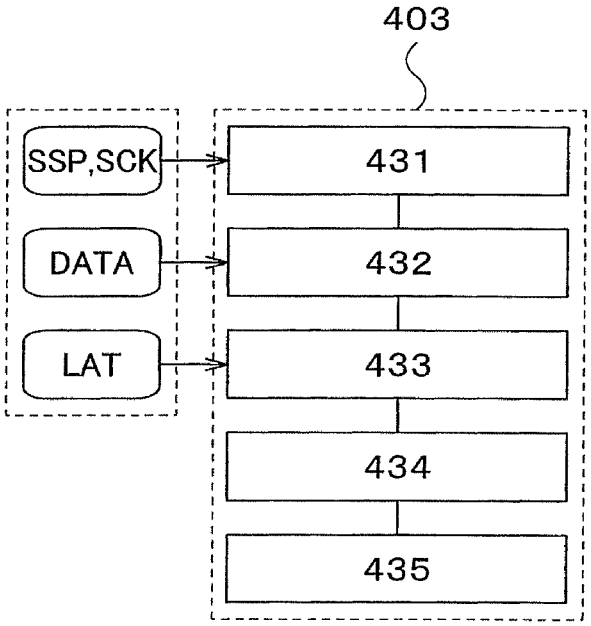

Next, an example of a structure of a signal line driver circuit is described with reference to FIG. 6B. FIG. 6B is a block diagram illustrating an example of a structure of a signal line driver circuit in a display device of this embodiment mode.

As illustrated in FIG. 6B, a signal line driver circuit 403 includes a shift register 431, a first latch circuit 432, a second latch circuit 433, a level shifter 434, and a buffer 435.

The buffer 435 has a function of amplifying a signal with a small amplitude and includes an operational amplifier or the like. A signal such as a start pulse (SSP) is inputted to the shift register 431, and data (DATA) such as a video signal is inputted to the first latch circuit 432. Latch (LAT) signals can be temporally held in the second latch circuit 433 and are simultaneously inputted to the pixel portion This is referred to as line sequential driving. Therefore, when a pixel is used in which not line sequential driving but dot sequential driving is performed, the second latch circuit 433 can be omitted.

Note that in this embodiment mode, a polarizing plate, a retardation plate, or a prism sheet can be provided on the surface opposite to a top surface of one substrate, which is provided with the pixels. A color filter, a black matrix, a counter electrode, an alignment film, or the like is formed on the other substrate. A polarizing plate or a retardation plate may be provided on the surface opposite to a top surface of the other of the substrates. The color filter and the black matrix may be formed on the top surface of one substrate. Note that three-dimensional display can be performed by providing a slit (a grid) on the top surface side or the side opposite to the top surface of one substrate.

In addition, each of the polarizing plate, the retardation plate, and the prism sheet can be provided between the two substrates. Alternatively, each of the polarizing plate, the retardation plate, and the prism sheet can be integrated with one of the two substrates.

Next, an operation of the display device in this embodiment mode is described.

Control signals are outputted to the scanning line driver circuit 304 and the signal line driver circuit 305 from the control circuit 306, whereby the scanning line driver circuit 304 outputs a scanning signal to the selected pixel 300 though the scanning line 302. Further, the signal line driver circuit 305 outputs a video signal to the selected pixel 300 though the signal line 303. The selected pixel performs the above-described display operation in accordance with the scanning signal and the video signal which are inputted thereto.

Figure 7A:
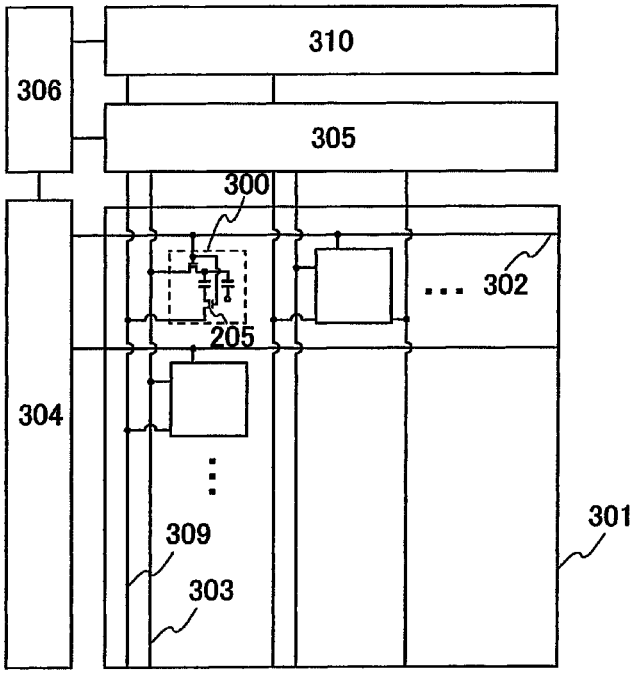
FIGS. 7A and 7B are each a circuit diagram illustrating another specific structure of a display device of the present invention in Embodiment Mode 2.
Figure 7B:
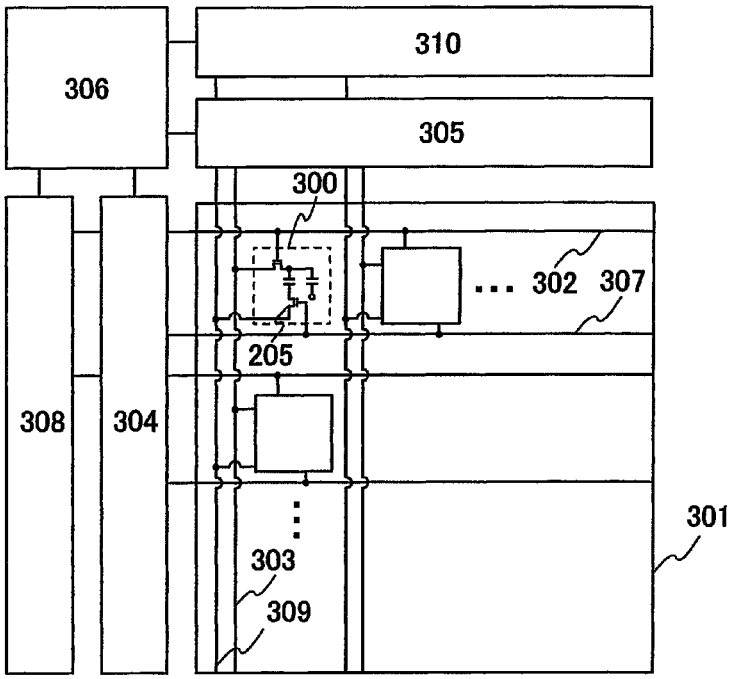

Note that when off-current of the first transistor 202 is high, leakage of electric charge from the second capacitor 204 is increased, and the amount of electric charge leaks from the first capacitor 203 to the second capacitor 204 in order to compensate for a drop in voltage of the second capacitor 204 is increased. Thus, voltage held in the first capacitor 203 is reduced, and voltage applied to the first capacitor 203 and the second capacitor 204 of the capacitors is averaged and thus reduced, resulting in reduction in voltage of the second capacitor 204. As a method for suppressing reduction in voltage of the second capacitor 204, the case where a potential of the other of the source terminal and the drain terminal of the second transistor 205 is set to a potential Vs having a predetermined value is described with reference to FIGS. 7A and 7B. FIGS. 7A and 7B are each a circuit diagram illustrating another structure of the display device in this embodiment mode.

As illustrated in FIGS. 7A and 7B, in the structures of the display device illustrated in FIGS. 2 and 3, a power supply line 309 is additionally provided and electrically connected to the other of the source terminal and the drain terminal of the second transistor 205 through the potential supply terminal 206. Moreover, a power supply circuit 310 is provided and electrically connected to the power supply line 309. FIG. 7A illustrates a structure where the other of the source terminal and the drain terminal of the second transistor 205 in the pixel structure illustrated in FIG. 2 is electrically connected to the power supply line 309. FIG. 7B illustrates a structure where the other of the source terminal and the drain terminal of the second transistor 205 in the pixel structure illustrated in FIG. 3 is electrically connected to the power supply line 309. At this time, the power supply circuit 310 is synchronized with the signal line driver circuit 305.

Next, an operation in the case where the power supply line 309 and the power supply circuit 310 are provided is described.

The power supply line 309 is set so that the potential of the other of the source terminal and the drain terminal of the second transistor 205 is set to the potential Vs by the power supply circuit 310. That is, the potential Vs is adjusted to a predetermined value in expectation of the amount of reduction in potential of a liquid crystal electrode caused by leakage of electric charge from the liquid crystal electrode in the pixel, and voltage of the first capacitor 203 at the time of writing is set higher than that of the second capacitor 204. Moreover, when the first transistor 202 has parasitic capacitance, change in voltage applied to a pixel electrode due to the feedthrough effect occurs. Feedthrough effect can be suppressed by adjustment of the potential of the other of the source terminal or the drain terminal of the second transistor 205 by the amount of potential shift of the first electrode of the second capacitor 204 due to feedthrough effect. Further, capacitance (the electrode area or the like) of the first capacitor 203 can be reduced by providing the power supply line 309, and thus, an aperture ratio of a manufactured display panel can be increased.

Figure 8:
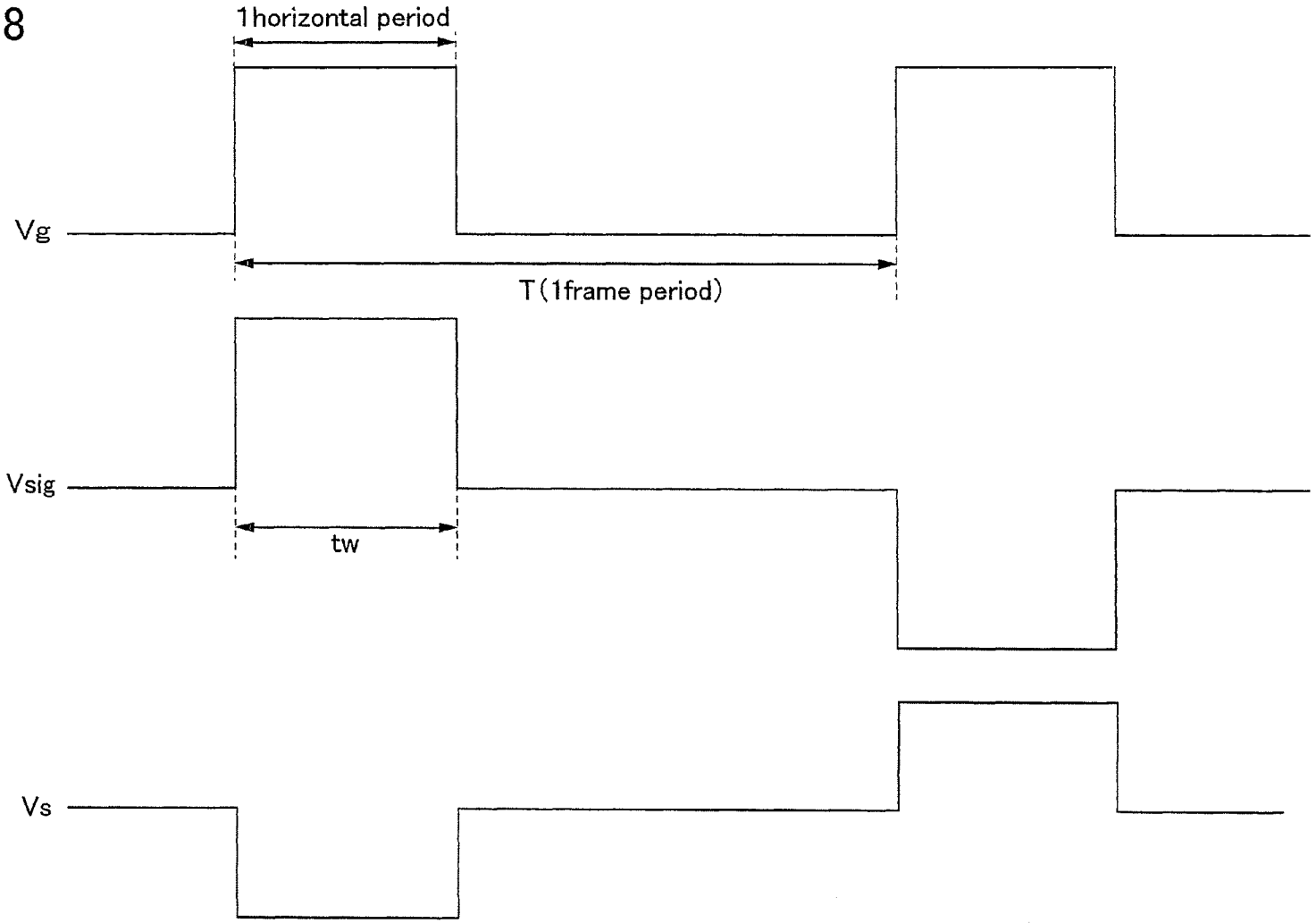
FIG. 8 is a timing chart illustrating an operation of a display device of the present invention in Embodiment Mode 2.

Next, timing of driving the display device in this embodiment mode is described with reference to FIG. 8. FIG. 8 is a timing chart illustrating an operation of the display device. Note that although the case of a frame inversion driving method is described as an example of a method of the operation in FIG. 8, the present invention is not limited thereto, and other driving methods can also be applied.

As illustrated in FIG. 8, at the time of writing, voltage (potential difference) $V_{sig}$ with a period tw is applied to a capacitor of liquid crystal (the second capacitor 204) $C_{liq}$ and voltage difference of $|V_{sig}-Vs|$ is applied to a storage capacitor (the first capacitor 203) $C_s$ in each one horizontal period. Here, a value of the predetermined potential Vs can be estimated as follows.

For example, when the time average of off-current of the first transistor 202 is denoted by $I_{off}$ and one frame period is denoted by T, the amount ΔQ of electric charge which leaks from the liquid crystal capacitor $C_{liq}$ in one frame period is given by the following formula.

[Formula 1]

$$\Delta Q = \int_0^T (I_{off})\,dt = I_{off} \times T \tag{1}$$

With the use of Formula 1, reduction $\Delta V_{liq}$ in voltage of the capacitor of liquid crystal corresponding to the amount ΔQ of electric charge which leaks from the capacitor of liquid crystal because of increase in off-current of the first transistor 202 is represented as follows.

[Formula 2]

$$\Delta V_{liq}=\Delta Q/C_{liq} \tag{2}$$

Since electric charge in the amount of ΔQ has to be moved from the storage capacitor $C_s$ to the liquid crystal capacitor $C_{liq}$ so that potential differences applied to the two capacitors are equal to $V_{sig}$, Vs may be set as follows.

[Formula 3]

$$|Vs|=\Delta Q/C_s \tag{3}$$

By inputting a signal to be the predetermined potential Vs from the outside, reduction in voltage of the second capacitor 204 due to increase in off-current of the first transistor 202 can be suppressed.

Figure 9A:
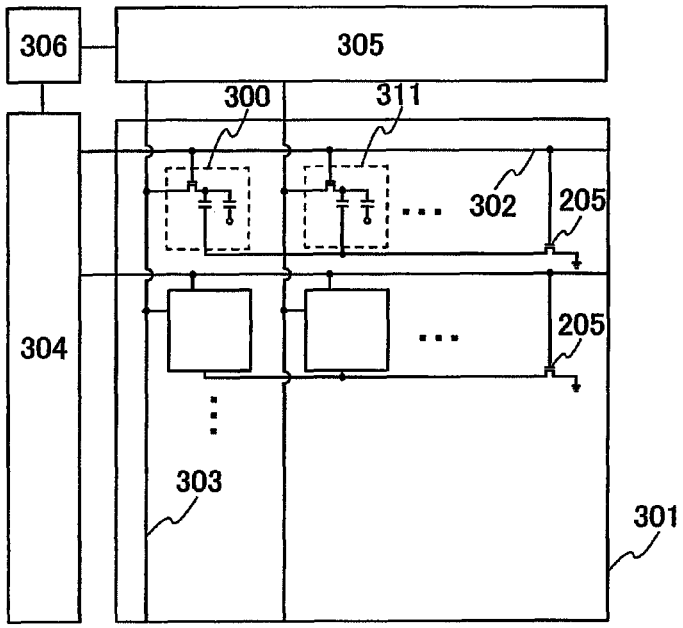
FIGS. 9A and 9B are each a circuit diagram illustrating another specific structure of a display device of the present invention in Embodiment Mode 2.
Figure 9B:
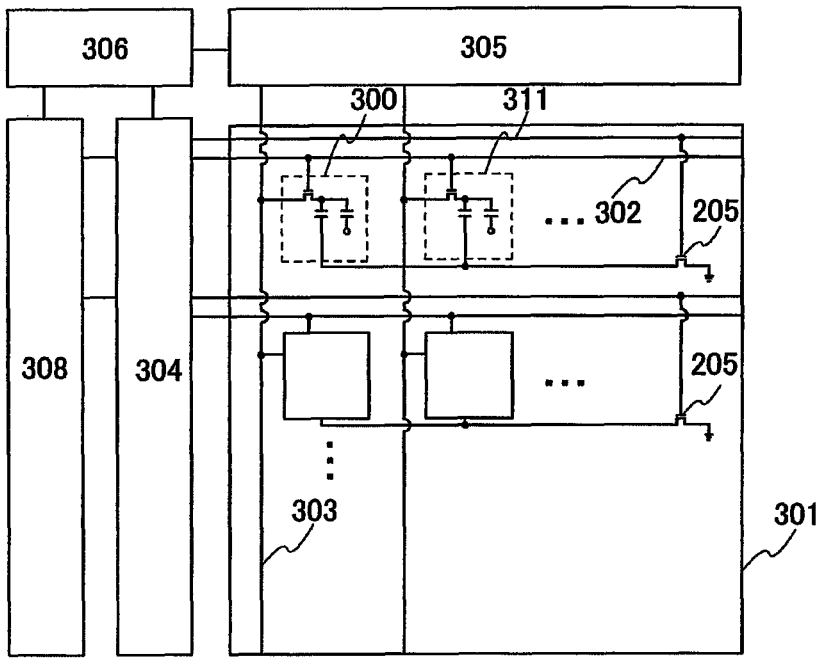

Further, although the case where the second transistor 205 is provided in each pixel is described in FIGS. 4 and 5, the second transistor 205 can be used in common in a plurality of pixels. An example of the case where the second transistor 205 is used in common in a plurality of pixels is described with reference to FIGS. 9A and 9B. FIGS. 9A and 9B are each a circuit diagram illustrating another structure of the display device in this embodiment mode.

As illustrated in FIGS. 9A and 9B, the second transistor 205 is electrically connected to the second electrodes of the first capacitors 203 in the pixel 300 and a pixel 311. FIG. 9A illustrates the case where the second transistor 205 in FIG. 2 is used in common in a plurality of pixels. FIG. 9B illustrates the case where the second transistor 205 in the pixel of FIG. 3 is used in common in a plurality of pixels. Moreover, in this embodiment mode, the second transistor 205 can be used in common not only in the pixels 300 and 311 but also in three or more pixels.

By using the second transistor 205 in common in a plurality of pixels, the area occupied by the transistors in each pixel can be reduced. Accordingly, a display device with a high contrast ratio can be provided.

As described above, by providing the second transistor 205 in the pixel of a liquid crystal display device, leakage of electric charge of the first capacitor 203 due to increase in off-current of the first transistor 202 can be reduced. Accordingly, drop in voltage applied to the capacitor of liquid crystal, which is the second capacitor 204, due to increase in off-current of the first transistor 202 can be compensated, and a liquid crystal display device with little display unevenness can be provided. Moreover, even in the case where high voltage is applied to the first transistor 202 such as the case of frame inversion driving, display unevenness can be reduced.

Note that this embodiment mode can be combined with other embodiment modes as appropriate.

Embodiment Mode 3

In this embodiment mode, an EL (electroluminescence) display device is described as an example of the display device of the present invention.

Figure 10:
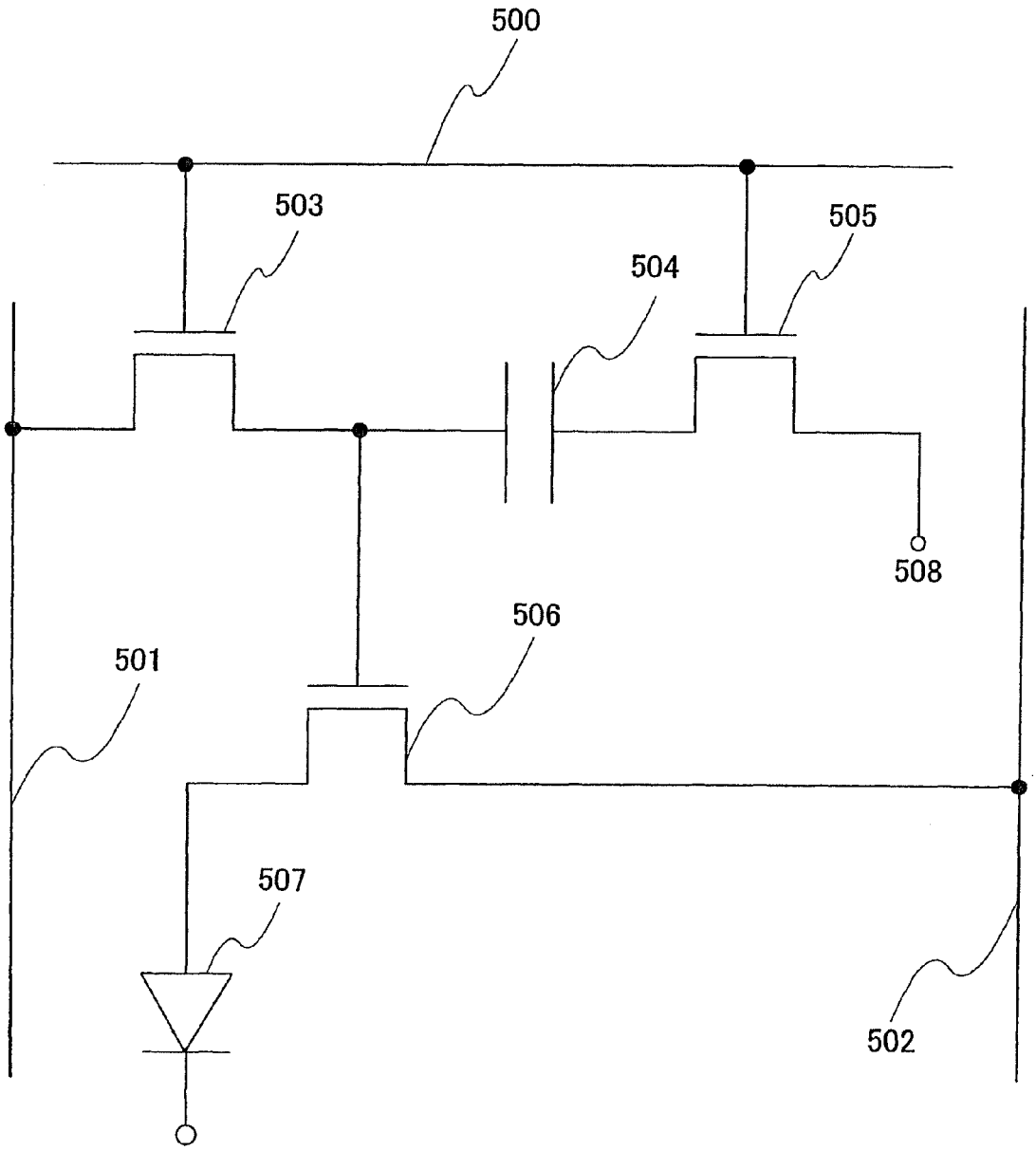
FIG. 10 is a circuit diagram illustrating a structure of a display device of the present invention in Embodiment Mode 3.

First, a structure of a display device in this embodiment mode is described with reference to FIG. 10. FIG. 10 is a circuit diagram illustrating a structure of the display device in this embodiment mode.

As illustrated in FIG. 10, the display device in this embodiment mode includes a scanning line 500, a signal line 501, a power supply line 502, and a pixel. The pixel includes a first transistor 503, a capacitor 504, a second transistor 506, a light-emitting element 507, a third transistor 505, and an electric charge supply terminal 508. A gate terminal of the first transistor 503 is electrically connected to the scanning line 500. One of a source terminal and a drain terminal of the first transistor 503 is electrically connected to the signal line 501. A first electrode of the capacitor 504 is electrically connected to the other of the source terminal and the drain terminal of the first transistor 503. A gate terminal of the second transistor 506 is electrically connected to the other of the source terminal and the drain terminal of the first transistor 503. One of a source terminal and a drain terminal of the second transistor 506 is electrically connected to the power supply line 502. A first electrode of the light-emitting element 507 is electrically connected to the other of the source terminal and the drain terminal of the second transistor 506. A gate terminal of the third transistor 505 is electrically connected to the scanning line 500. One of a source terminal and a drain terminal of the third transistor 505 is electrically connected to a second electrode of the capacitor 504. The electric charge supply terminal 508 is electrically connected to the other of the source terminal and the drain terminal of the third transistor 505.

The first transistor 503 functions as a switching element and is turned on or off in accordance with a potential applied to the gate terminal from the scanning line 500.

The capacitor 504 has a function as a storage capacitor and a function of holding a potential of the gate terminal of the second transistor 506 (a potential of the signal line) in a state of holding display. The first transistor 503 and the third transistor 505 are turned on and a video signal is inputted from the signal line 501 to the capacitor 504, whereby electric charge is stored in the capacitor 504 and voltage is applied to the capacitor 504.

The third transistor 505 has a function as a switching element and a function of being on or off in accordance with a signal inputted from the scanning line 500 to the gate electrode. The third transistor 505 is turned on, whereby the second electrode of the capacitor 504 is grounded.

The second transistor 506 has a function of controlling driving of the light-emitting element 507, and is turned on or off in accordance with a signal inputted to the gate terminal. Further, the second transistor 506 is turned on, whereby voltage is applied to the light-emitting element 507 from the power supply line 502 through the second transistor 506.

The first electrode of the light-emitting element 507 is electrically connected to the other of the source terminal or the drain terminal of the second transistor 506. A second electrode of the light-emitting element 507 is grounded or held at another potential. Moreover, the light-emitting element 507 has a function of emitting light by current flowing therethrough. For the light-emitting element 507, a structure including a first electrode, a second electrode, and an EL (Electro Luminescence) layer interposed between the first electrode and the second electrode, or the like can be applied. The intensity of light emission in the light-emitting element 507 is changed in accordance with the amount of electric charge depending on the current flowing through the light-emitting element 507.

The electric charge supply terminal 508 has a function of supplying electric charge to the capacitor 504 when the third transistor 505 is on. Note that the electric charge supply terminal 508 can be grounded. Alternatively, the electric charge supply terminal 508 can be electrically connected to a power supply line that is additionally provided.

Next, an example of an operation of the display device in this embodiment mode is described.

As methods for driving an EL display device, there are an analog method and a digital method. In this embodiment mode, the analog method is described as an example; however, the present invention is not limited thereto, and the EL display device can be operated by other driving methods.

First, the first transistor 503 and the third transistor 505 are turned on, whereby a signal from the signal line 501 is inputted to the first electrode of the capacitor 504, and predetermined voltage is applied to the capacitor 504. Moreover, a signal potential conducted from the signal line 501 is inputted to the gate terminal of the second transistor 506. The second transistor 506 is turned on in accordance with the signal potential inputted to the gate terminal, and current is supplied to the light-emitting element 507 from the power supply line 502 through the second transistor 506. The light-emitting element 507 displays an image by emitting light in accordance with the amount of current flowing therethrough.

Next, a holding operation is described. At the time of a holding state, the first transistor 503 and the third transistor 505 are turned off, whereby electric charge stored in the capacitor 504 is held, and voltage applied to the capacitor 504 is also held.

At the time of writing, a high electric field is applied to the drain terminal of the first transistor 503, and hot carriers are generated. Off-current of the first transistor 503 is increased due to hot carriers, and electric charge is likely to leak from the first electrode of the capacitor 504 through the first transistor 503. In the case where a resistor as large as channel resistance when a transistor is off is added to the second electrode of the capacitor 504, electric charge is not moved from the first electrode even if the first electrode of the capacitor 504 is electrically conductive. This is because in order that electric charge leaks from the first electrode of the capacitor 504, a corresponding amount of electric charge which has leaked from the first electrode is necessarily supplied to the second electrode of the capacitor 504; however, the third transistor 505 is off, and electric charge is not supplied from the electric charge supply terminal 508 to the second electrode of the capacitor 504. At the time of writing, high voltage is not applied to the third transistor 505, and the third transistor 505 is less likely to degrade as compared to the first transistor 503, so that resistance in an off state of the third transistor 505 is higher than that of the first transistor 503. Accordingly, leakage of electric charge of the capacitor 504 due to increase in off-current of the first transistor 503 can be reduced, and reduction in voltage applied to the capacitor 504 can be suppressed.

As described above, by providing the third transistor 505 so as to suppress influence of increase in off-current of the first transistor 503, leakage of electric charge of the capacitor 504 due to increase in off-current of the first transistor 503 can be reduced, and display unevenness can be reduced.

Figure 11:
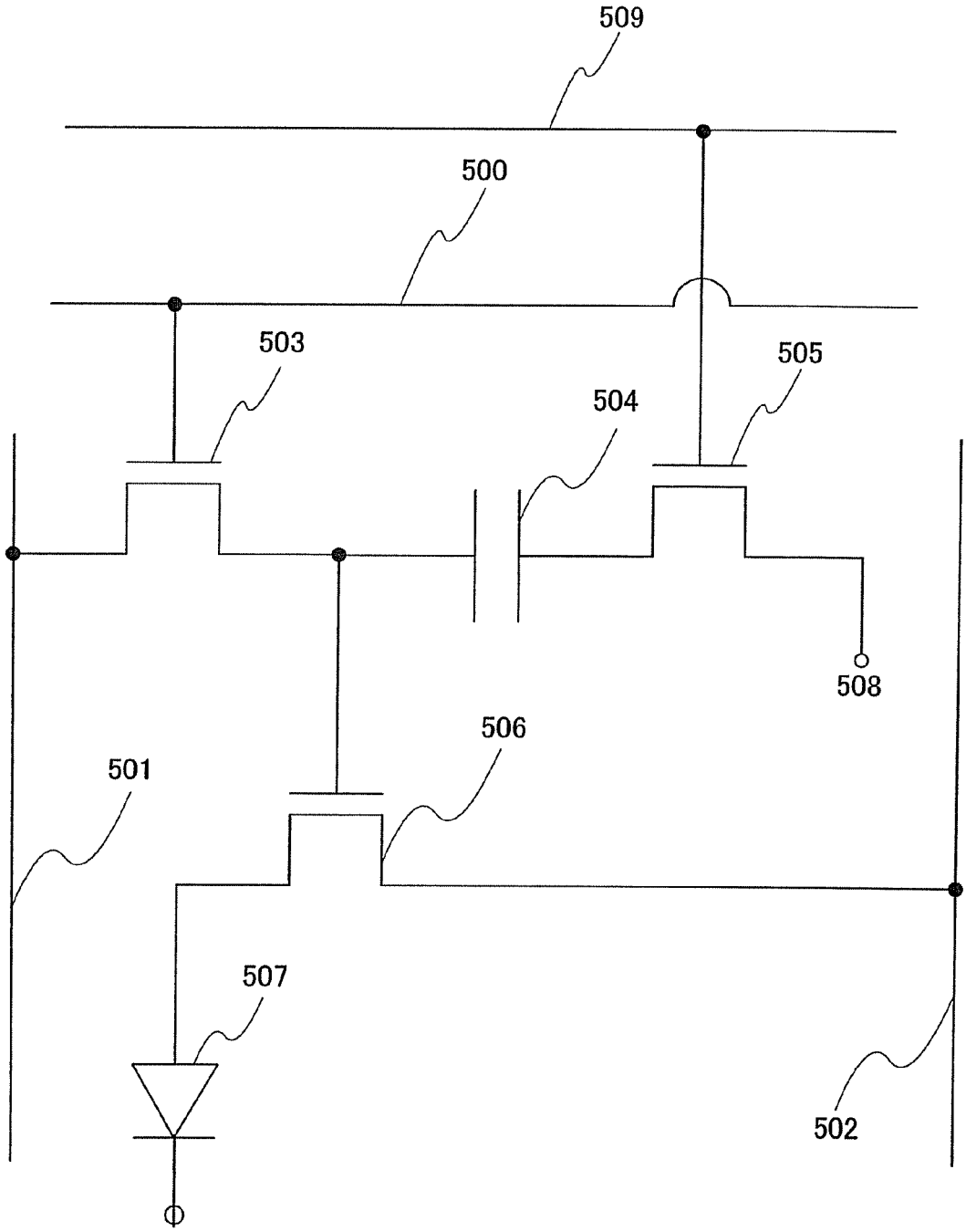
FIG. 11 is a circuit diagram illustrating another structure of a display device of the present invention in Embodiment Mode 3.

In addition, the structure of the display device in this embodiment mode can be applied not only to the above-described structure but also to other structures. Another structure example of the display device in this embodiment mode is described with reference to FIG. 11. FIG. 11 is a circuit diagram illustrating another structure example of the display device in this embodiment mode.

As illustrated in FIG. 11, the display device with another structure in this embodiment mode includes the first scanning line 500, a second scanning line 509, the signal line 501, the power supply line 502, and a pixel. The pixel includes the first transistor 503, the capacitor 504, the second transistor 506, the light-emitting element 507, the third transistor 505, and the electric charge supply terminal 508. The gate terminal of the first transistor 503 is electrically connected to the first scanning line 500. One of the source terminal and the drain terminal of the first transistor 503 is electrically connected to the signal line 501. The first electrode of the capacitor 504 is electrically connected to the other of the source terminal and the drain terminal of the first transistor 503. The gate terminal of the second transistor 506 is electrically connected to the other of the source terminal and the drain terminal of the first transistor 503. One of the source terminal and the drain terminal of the second transistor 506 is electrically connected to the power supply line 502. A first electrode of the light-emitting element 507 is electrically connected to, the other of the source terminal and the drain terminal of the second transistor 506. The gate terminal of the third transistor 505 is electrically connected to the first scanning line 500. One of the source terminal and the drain terminal of the third transistor 505 is electrically connected to the second electrode of the capacitor 504. The electric charge supply terminal 508 is electrically connected to the other of the source terminal and the drain terminal of the third transistor 505.

The first transistor 503 functions as a switching element and is turned on or off in accordance with a signal potential inputted to the gate terminal from the first scanning line 500.

The capacitor 504 has a function as a storage capacitor and compensates change of voltage of the light-emitting element 507 in the passage of time. The first transistor 503 is turned on and a video signal is inputted from the signal line 501 to the capacitor 504, whereby electric charge is stored in the capacitor 504 and voltage is applied to the capacitor 504.

The third transistor 505 has a function as a switching element and a function of being on or off in accordance with a signal potential inputted from the second scanning line 509 to the gate electrode. The third transistor 505 is turned on, whereby the second electrode of the capacitor 504 is grounded.

The second transistor 506 has a function of controlling driving of the light-emitting element 507, and is turned on or off in accordance with a signal potential inputted to the gate terminal. Further, the second transistor 506 is turned on, whereby voltage is applied to the light-emitting element 507 from the power supply line 502 through the second transistor 506.

The first electrode of the light-emitting element 507 is electrically connected to the other of the source terminal or the drain terminal of the second transistor 506. A second electrode of the light-emitting element 507 is grounded or held at another potential. Moreover, the light-emitting element 507 has a function of emitting light by input of current. For the light-emitting element 507, a structure including a first electrode, a second electrode, and an EL layer interposed between the first electrode and the second electrode, or the like can be applied. The intensity of light emission in the light-emitting element 507 is changed in accordance with the amount of electric charge depending on the current flowing therethrough.

The electric charge supply terminal 508 has a function of supplying electric charge to the capacitor 504 when the third transistor 505 is on. Note that the electric charge supply terminal 508 can be grounded. Alternatively, the electric charge supply terminal 508 can be electrically connected to a power supply line that is additionally provided.

Next, an example of an operation of the display device in this embodiment mode is described.

First, the first transistor 503 and the third transistor 505 are turned on, whereby a signal potential from the signal line 501 is inputted to the capacitor 504, and predetermined voltage is applied to the capacitor 504. Moreover, a signal potential conducted from the signal line 501 is inputted to the gate terminal of the second transistor 506. The second transistor 506 is turned on in accordance with the signal potential inputted to the gate terminal, and current is outputted to the light-emitting element 507 from the power supply line 502 through the second transistor 506. The light-emitting element 507 displays an image by emitting light in accordance with the amount of current flowing therethrough.

Next, a holding operation is described. At the time of a holding state, the first transistor 503 and the third transistor 505 are turned off, whereby electric charge stored in the capacitor 504 is held, and a value of voltage is also held.

At the time of writing, off-current of the first transistor 503 is increased due to hot carrier degradation, and electric charge is likely to leak from the first electrode of the capacitor 504 through the first transistor 503. In the case where a resistor large enough to ignore leakage of electric charge is added to the second electrode of the capacitor 504, electric charge do not leak from the first electrode even if the first electrode of the capacitor 504 is almost electrically conductive. This is because in order that electric charge leaks from the first electrode of the capacitor 504, a corresponding amount of electric charge which has leaked from the first electrode is necessarily supplied to the second electrode; however, the third transistor 505 is off, and electric charge is not supplied to the second electrode of the capacitor 504 from the electric charge supply terminal 508. At the time of writing, high voltage such as voltage applied to the first transistor is not applied to the third transistor 505, and the third transistor 505 is less likely to degrade as compared to the first transistor 503, so that resistance in an off state of the third transistor 505 is higher than that of the first transistor 503. Accordingly, leakage of electric charge of the capacitor 504 due to increase in off-current of the first transistor 503 can be reduced, and drop in voltage applied to the capacitor 504 can be suppressed.

As described above, by electrically connecting two transistors in the pixel to different scanning lines, timing of the operation can be individually set. Moreover, flexibility in selecting design can be increased, for example, the first transistor and the second transistor may have different conductivity.

Figure 12:
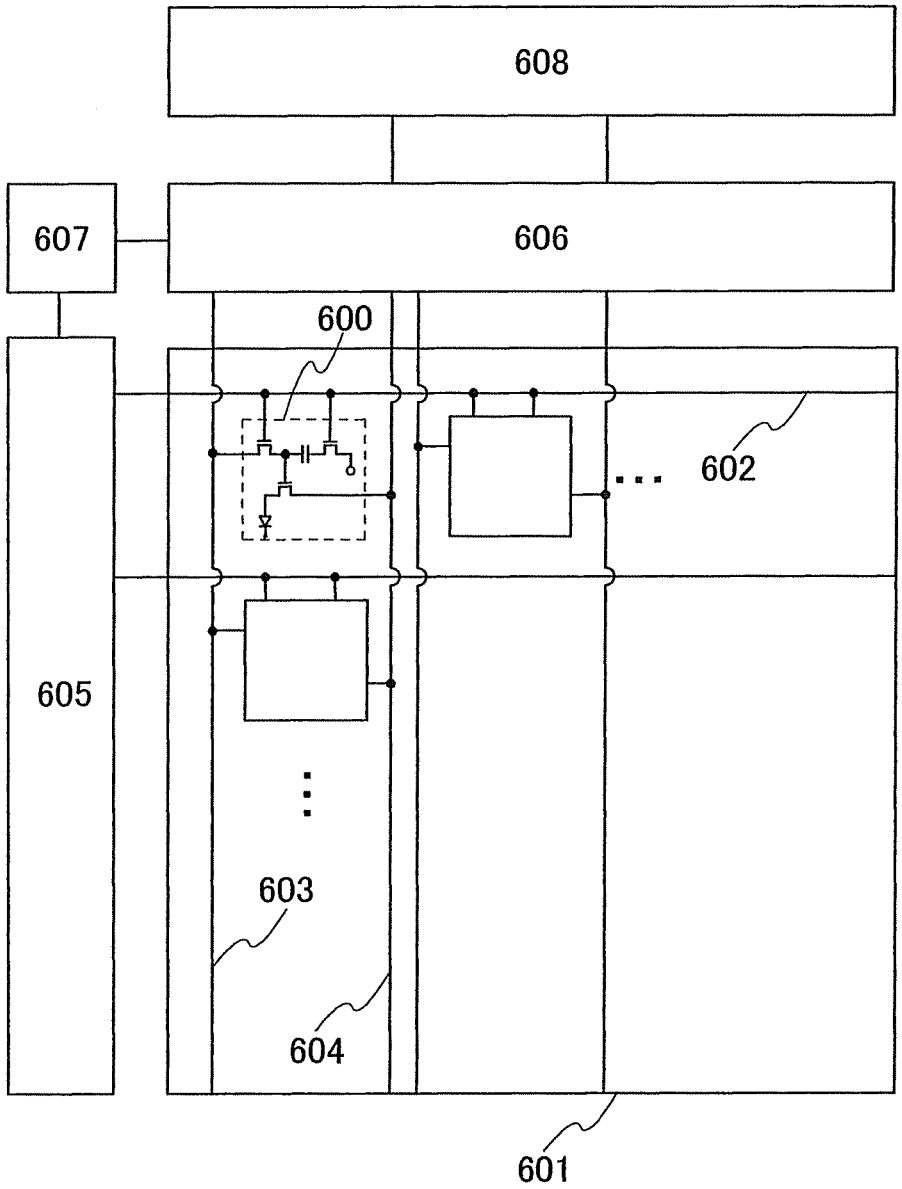
FIG. 12 is a circuit diagram illustrating a specific structure of a display device of the present invention in Embodiment Mode 3.

Next, a specific structure of the display device in this embodiment mode is described with reference to FIG. 12. FIG. 12 is a circuit diagram illustrating a specific structure of the display device in this embodiment mode.

As illustrated in FIG. 12, the display device in this embodiment mode includes a pixel portion 601 including a plurality of pixels 600, a scanning line 602, a signal line 603, a power supply line 604, a scanning line driver circuit (a gate driver) 605 which is electrically connected to the scanning line 602, a signal line driver circuit (a source driver) 606 which is electrically connected to the signal line 603 and the power supply line 604, a control circuit 607 which is electrically connected to the scanning line driver circuit 605 and the signal line driver circuit 606, and a power supply circuit 608 which is electrically connected to the pixel portion 601.

The plurality of pixels 600 provided in the pixel portion 601 are arranged in matrix in intersection regions of the signal lines 603 and the scanning lines 602. A signal can be inputted individually to each pixel. Note that the pixel structure illustrated in FIG. 9A or 9B can be applied to the plurality of pixels 600 provided in the pixel portion 601. The scanning line 602, the signal line 603, and the power supply line 604 correspond to the scanning line 500, the signal line 501, and the power supply line 502 in FIG. 10.

Figure 13:
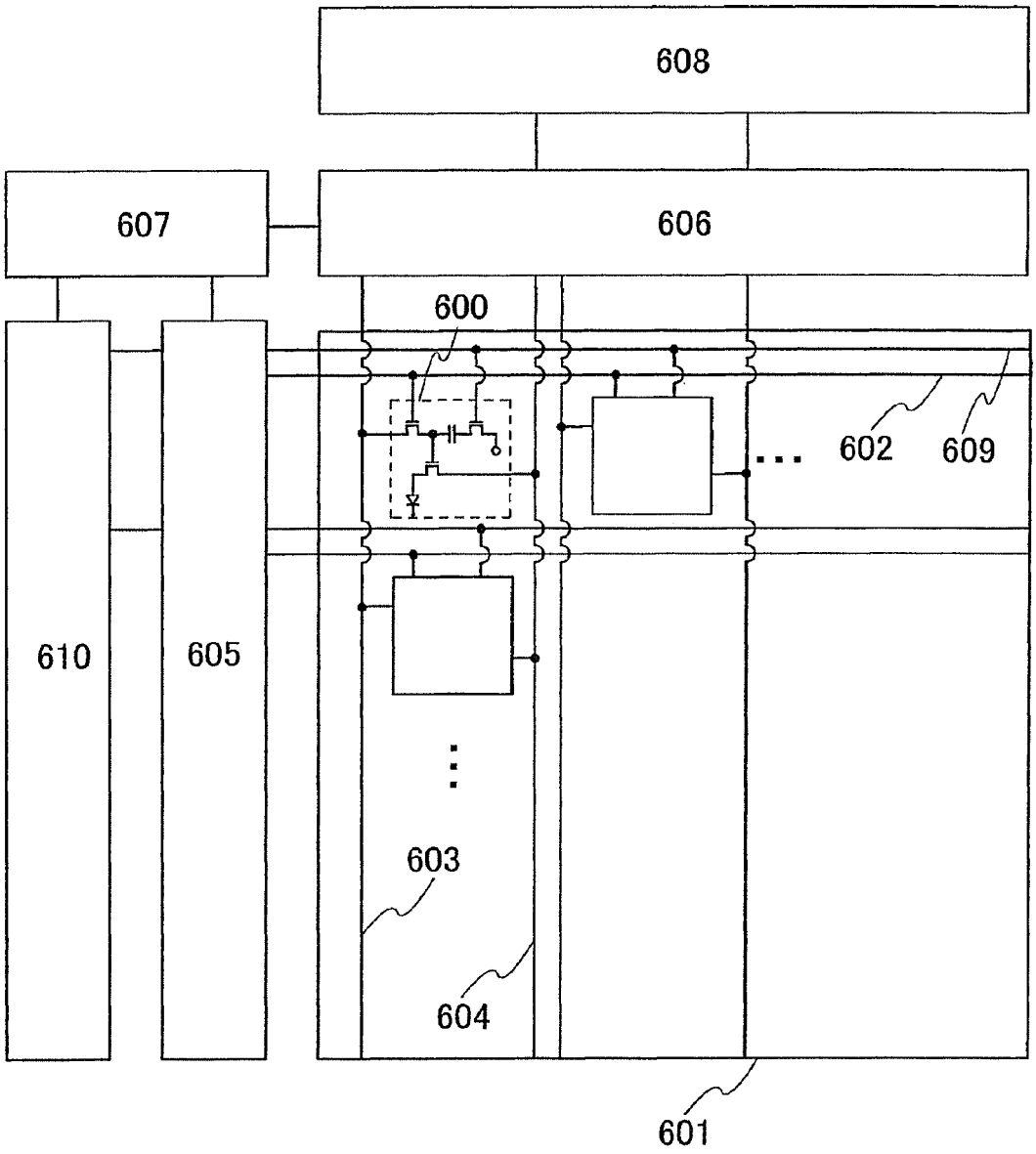
FIG. 13 is a circuit diagram illustrating another specific structure of a display device of the present invention in Embodiment Mode 3.

Alternatively, in the display device of this embodiment mode, the structure illustrated in FIG. 11 can be used. When the structure illustrated in FIG. 11 is applied, as illustrated in FIG. 13, a second scanning line 609 and a second scanning line driver circuit 610 are provided, the second scanning line 609 is electrically connected to the gate terminal of the third transistor 505, and the third transistor 505 is controlled in accordance with a signal potential conducted from the second scanning line driver circuit 610. Note that the second scanning line 609 corresponds to the second scanning line 509 in FIG. 11.

The control circuit 607 has a function of controlling the scanning line driver circuit 605 and the signal line driver circuit 606 in accordance with an inputted video signal. Specifically, the control circuit 607 outputs a control signal to each of the scanning line driver circuit 605 and the signal line driver circuit 606.

The scanning line driver circuit 605 has a function of outputting a scanning signal to the scanning line 602 in accordance with the control signal inputted from the control circuit 607.

The signal line driver circuit 606 has a function of outputting a video signal to the signal line in accordance with the control signal inputted from the control circuit 607.

The power supply circuit 608 has a function of providing a power supply potential to the power supply line 604.

Note that a structure similar to that of the display device in Embodiment Mode 2 can be applied to the structures of the scanning line driver circuit and the signal line driver circuit, and thus, description thereof is omitted.

Next, an operation of the display device in this embodiment mode is described.

Control signals are outputted to the scanning line driver circuit 605 and the signal line driver circuit 606 from the control circuit 607, whereby the scanning line driver circuit 605 outputs a scanning signal to the selected pixel 600 though the scanning line 602. Further, the signal line driver circuit 606 outputs a video signal to the selected pixel 600 though the signal line 603. The selected pixel performs the above-described display operation in accordance with the scanning signal and the video signal which are inputted thereto.

As described above, displaying an image can be performed in the pixel portion. Moreover, by providing the second transistor for the second electrode of the storage capacitor, leakage of electric charge of the capacitor due to increase in off-current of the first transistor can be reduced, and display unevenness can be suppressed.

Note that this embodiment mode can be combined with other embodiment modes as appropriate.

Embodiment Mode 4

In this embodiment mode, structures and manufacturing methods of transistors which can be used in the display device of the present invention are described.

Figure 14:
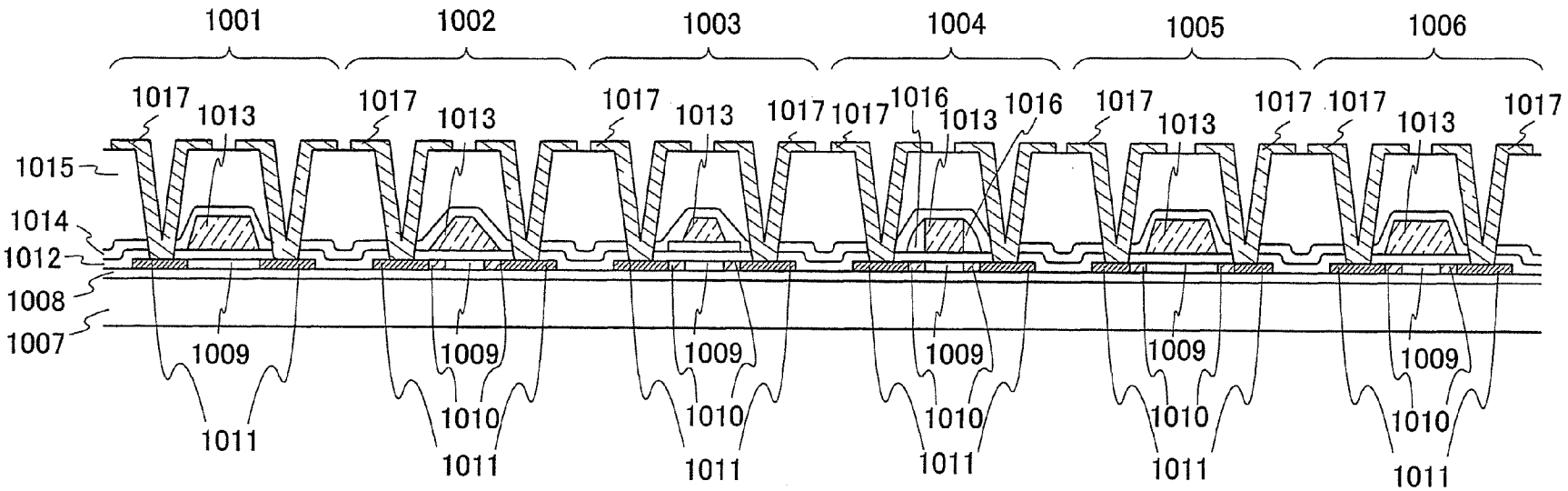
FIG. 14 is a schematic view illustrating structures of transistors applicable to a display device of the present invention in Embodiment Mode 4.

Structures of transistors which can be used in the display device of the present invention in this embodiment mode are described with reference to FIG. 14. FIG. 14 is a schematic view illustrating structure examples of transistors in this embodiment mode.

As illustrated in FIG. 14, as the transistors which can be used in the display device of this embodiment mode, a plurality of transistors having different structures, such as a first transistor 1001, a second transistor 1002, a third transistor 1003, a fourth transistor 1004, a fifth transistor 1005, and a sixth transistor 1006, can be applied. Each transistor includes a substrate 1007, a base film 1008 provided over the substrate 1007, a semiconductor layer 1009 provided over the base film 1008, a gate insulating film 1012 provided so as to cover the semiconductor layer 1009, a gate electrode 1013 provided over part of the gate insulating film 1012, a first insulating film 1014 provided so as to cover the gate electrode 1013, a second insulating film 1015 provided over the first insulating film 1014, and a wiring 1017 provided in contact with a region 1011 in the semiconductor layer 1009 through the second insulating film 1015, the first insulating film 1014, and the gate insulating film 1012.

The impurity region 1011 is included in part of the semiconductor layer 1009. The semiconductor layer 1009 also includes a channel region in a region located below the gate electrode 1013. At this time, the impurity region 1011 is used as a source region or a drain region. Note that in FIG. 14, the plurality of transistors each having a different structure are juxtaposed, which is convenient for describing the structures of the transistors. Accordingly, the transistors need not be actually juxtaposed as illustrated in FIG. 14 and can be differently formed as needed.

Next, the structure of each transistor in FIG. 14 is described.

The first transistor 1001 is a single drain transistor. Since the single drain transistor can be formed by a simple method, it is advantageous in low manufacturing cost and high yield. By controlling the amount of impurities in the semiconductor layer 1009 of the first transistor 1001, the resistivity of the semiconductor layer 1009 can be controlled. Moreover, a contact of the semiconductor layer 1009 and the wiring 1017 can be closer to ohmic contact. Note that as a method of forming the semiconductor layers having different amounts of impurities, a method can be used in which the semiconductor layer 1009 is doped with impurities using the gate electrode 1013 as a mask.

The second transistor 1002 is a transistor in which the gate electrode 1013 is tapered at an angle of at least certain degrees. Since the transistor can be formed by a simple method, it is advantageous in low manufacturing cost and high yield. The semiconductor layer 1009 of the second transistor 1002 includes the impurity region 1011 as a first impurity region, and a second impurity region 1010 between the impurity region 1011 and the channel region. The impurity region 1011, the channel region, and the second impurity region 1010 have different concentrations of impurities. The second impurity region 1010 is used as a lightly doped drain (LDD) region. By controlling the amount of impurities in such a manner, the resistivity of the semiconductor layer 1009 can be controlled. A contact of the semiconductor layer 1009 and the wiring 1017 can be closer to ohmic contact. Since the transistor includes the LDD region, a high electric field is hardly applied inside the transistor, and degradation of the element due to hot carriers can be suppressed. Note that as a method of forming the semiconductor layers having different amounts of impurities, a method can be used in which the semiconductor layer 1009 is doped with impurities using the gate electrode 1013 as a mask. In the transistor 1002, since the gate electrode 1013 is tapered at an angle of at least certain degrees, gradient of the concentration of impurities added to the semiconductor layer 1009 through the gate electrode 1013 can be provided, and the LDD region can be easily formed.

The third transistor 1003 is a transistor in which the gate electrode 1013 includes at least two layers and a lower gate electrode is longer than an upper gate electrode. In this specification, the shape of the lower and upper gate electrodes is called a hat shape. When the gate electrode 1013 has a hat shape, an LDD region can be formed without addition of a photoresist mask. Note that a structure where the LDD region overlaps with the gate electrode 1013, like the third transistor 1003, is particularly called a GOLD (Gate OverLapped Drain) structure. As a method of forming the gate electrode 1013 with a hat shape, the following method may be used.

First, when the gate electrode 1013 is patterned, the lower and upper gate electrodes are etched by dry etching so that side surfaces thereof are inclined (tapered). Then, the inclination of the upper gate electrode is processed to be almost perpendicular by anisotropic etching. Thus, the gate electrode of which cross section is a hat shape is formed. After that, an impurity element is added twice, so that the channel region, the second impurity region 1010 used as the LDD region, and the impurity region 1011 used as a source electrode or a drain electrode are formed.

Note that a part of the LDD region, which overlaps with the gate electrode 1013, is referred to as an Lov region, and a part of the LDD region, which does not overlap with the gate electrode 1013, is referred to as an Loff region. Here, the Loff region is highly effective in suppressing an off-current value, whereas it is not very effective in lowering an electric field in the vicinity of the drain and preventing degradation of on-current value due to hot carriers. On the other hand, the Lov region is effective in lowering the electric field in the vicinity of the drain and preventing degradation of on-current value, whereas it is not very effective in suppressing the off-current value. Thus, it is preferable to form a transistor having a structure appropriate for characteristics of each of various circuits. For example, when a semiconductor device is applied to the display device, a transistor having an Loff region is preferably used as a transistor used in a pixel portion in order to suppress the off-current value. On the other hand, as a transistor used in a peripheral circuit, a transistor having an Lov region is preferably used in order to relieve the electric field in the vicinity of the drain and prevent degradation of on-current value.

The fourth transistor 1004 is a transistor including a sidewall 1016 in contact with the side surface of the gate electrode 1013. By providing the sidewall 1016, a region overlapping with the sidewall 1016 can serve as an LDD region.

The fifth transistor 1005 is a transistor including an LDD (Loff) region provided by doping the semiconductor layer with the use of a mask. When doping is performed on the semiconductor layer with the use of the mask, the LDD region can be formed, and an off-current value of the transistor can be reduced.

The sixth transistor 1006 is a transistor including an LDD (Lov) region provided by doping the semiconductor layer with the use of a mask. When doping is performed on the semiconductor layer with the use of the mask, the LDD region can be formed. Moreover, by employing the structure including the Lov region, the electric field in the vicinity of the drain of the transistor can be lowered, and degradation of on-current value can be prevented.

Next, characteristics of each layer included in the transistors are described.

The substrate 1007 can be a glass substrate using barium borosilicate glass, aluminoborosilicate glass, or the like, a quartz substrate, a ceramic substrate, a metal substrate containing stainless steel, or the like. Further, a substrate formed of plastics typified by polyethylene terephthalate (PET), polyethylene naphthalate (PEN), or polyethersulfone (PES), or a substrate formed of a flexible synthetic resin such as acrylic can also be used. By using a flexible substrate, a semiconductor device capable of being bent can be formed. A flexible substrate has no strict limitations on the area or the shape of the substrate. Accordingly, for example, when a substrate having a rectangular shape, each side of which is 1 meter or more, is used as the substrate 1007, productivity can be significantly improved. Such an advantage is highly favorable as compared to the case where a circular silicon substrate is used.

The base film 1008 has a function of preventing alkali metal such as Na or alkaline earth metal diffusing from the substrate 1007 from adversely affecting characteristics of a semiconductor element. The base film 1008 can have a single-layer structure or a stacked-layer structure of an insulating film containing oxygen or nitrogen, such as silicon oxide, silicon nitride, silicon oxynitride, or silicon nitride oxide. For example, when the base film 1008 is provided to have a two-layer structure, it is preferable that a silicon nitride oxide film be provided as a first layer and a silicon oxynitride film be provided as a second layer. As another example, when the base film 1008 is provided to have a three-layer structure, it is preferable that a silicon oxynitride film be provided as a first layer, a silicon nitride oxide film be provided as a second layer, and a silicon oxynitride film be provided as a third layer.

The semiconductor layer 1009 can be formed using an amorphous semiconductor or a microcrystalline (microcrystal) semiconductor. Alternatively, a polycrystalline semiconductor layer may be used. For example, the microcrystalline semiconductor is formed by glow discharge decomposition (plasma CVD) of a material gas. As the material gas, $Si_2H_6$, $SiH_2Cl_2$, $SiHCl_3$, $SiCl_4$, $SiF_4$, or the like as well as $SiH_4$ can be used. Alternatively, $GeF_4$ may be mixed. The material gas may be diluted with $H_2$, or $H_2$ and one or more kinds of rare gas elements selected from He, Ar, Kr, and Ne. A dilution ratio is in the range of 2 to 1000 times. Pressure is in the range of approximately 0.1 to 133 Pa, and a power supply frequency is 1 to 120 MHz, preferably 13 to 60 MHz. A substrate heating temperature may be 300° C. or lower. A concentration of impurities in atmospheric components such as oxygen, nitrogen, and carbon is preferably $1\times10^{20}$ $cm^{-1}$ or less as impurity elements in the film. In particular, an oxygen concentration is $5\times10^{19}/cm^3$ or less, preferably $1\times10^{19}/cm^3$ or less. Here, an amorphous semiconductor layer is formed using a material containing silicon as its main component (e.g., $Si_xGe_{1-x}$) by a sputtering method, an LPCVD method, a plasma CVD method, or the like. Then, the amorphous semiconductor layer is crystallized by a known crystallization method such as a laser crystallization method, a thermal crystallization method using RTA or an annealing furnace, or a thermal crystallization method using a metal element which promotes crystallization.

The gate insulating film 1012 can have a single-layer structure or a stacked-layer structure of an insulating film containing oxygen or nitrogen, such as silicon oxide, silicon nitride, silicon oxynitride, or silicon nitride oxide.

The gate electrode 1013 can have a single-layer structure of a conductive film or a stacked-layer structure of two or three conductive films. As a material for the gate electrode 1013, a conductive film can be used. For example, a single film of an element such as tantalum, titanium, molybdenum, tungsten, chromium, or silicon; a nitride film containing the above element (typically, a tantalum nitride film, a tungsten nitride film, or a titanium nitride film); an alloy film in which the above elements are combined (typically, a Mo—W alloy or a Mo—Ta alloy); a silicide film containing the above element (typically, a tungsten silicide film or a titanium silicide film); or the like can be used. Note that the above single film, nitride film, alloy film, silicide film, or the like can have a single-layer structure or a stacked-layer structure.

The first insulating film 1014 can have a single-layer structure or a stacked-layer structure of an insulating film containing oxygen or nitrogen, such as silicon oxide, silicon nitride, silicon oxynitride, or silicon nitride oxide; or a film containing carbon, such as a DLC (diamond-like carbon).

The second insulating film 1015 can have a single-layer structure or a stacked-layer structure of a siloxane resin; an insulating film containing oxygen or nitrogen, such as silicon oxide, silicon nitride, silicon oxynitride, or silicon nitride oxide; a film containing carbon, such as a DLC (diamond-like carbon); or an organic material such as epoxy, polyimide, polyamide, polyvinyl phenol, benzocyclobutene, or acrylic. Note that a siloxane resin corresponds to a resin having Si—O—Si bonds. Siloxane has a skeleton structure with a bond of silicon and oxygen. As a substituent, an organic group containing at least hydrogen (such as an alkyl group or aromatic hydrocarbon) is used. A fluoro group may be included in the organic group. Note that the second insulating film 1015 can be directly provided so as to cover the gate electrode 1013 without provision of the first insulating film 1014.

As the wiring 1017, a single film of an element such as aluminum, nickel, carbon, tungsten, molybdenum, titanium, platinum, copper, tantalum, gold, or manganese, a nitride film containing the above element, an alloy film in which the above elements are combined, a silicide film containing the above element, or the like can be used. For example, as an alloy containing a plurality of the above elements, an aluminum alloy containing copper and titanium, an aluminum alloy containing nickel, an aluminum alloy containing copper and nickel, an aluminum alloy containing copper and manganese, or the like can be used. For example, when the wiring has a stacked-layer structure, a structure can be employed in which aluminum is interposed between molybdenum, titanium, or the like. With the above-described structure, resistance of aluminum to heat and chemical reaction can be increased.

Next, an example of a method of manufacturing transistors is described with reference to FIGS. 15A to 15E. FIGS. 15A to 15E are schematic views illustrating a method of manufacturing transistors. Note that the structure and the manufacturing method of the transistors are not limited to those illustrated in FIGS. 15A to 15E, and a variety of structures and manufacturing methods can be used.

Figure 15A:
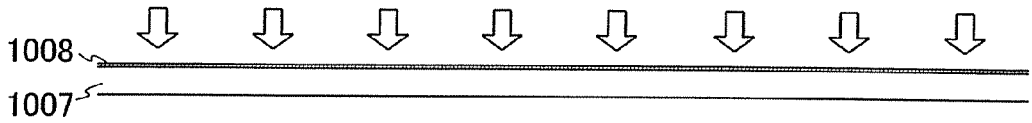
FIGS. 15A to 15E are schematic views illustrating a manufacturing method of a transistor applicable to a display device of the present invention in Embodiment Mode 4.

First, as illustrated in FIG. 15A, the base film 1008 is formed over the substrate 1007. Next, a surface of the base film 1008 is oxidized or nitrided by plasma treatment. Note that the plasma treatment can also be performed after another layer is formed in this manufacturing method. By oxidizing or nitriding the semiconductor layer or the insulating film by the plasma treatment in such a manner, the surface of the semiconductor layer or the insulating film is modified, and the insulating film can be formed to be denser than an insulating film formed by a CVD method or a sputtering method. Accordingly, generation of defects such as a pinhole can be suppressed, and characteristics and the like of the semiconductor device can be improved.

Figure 15B:
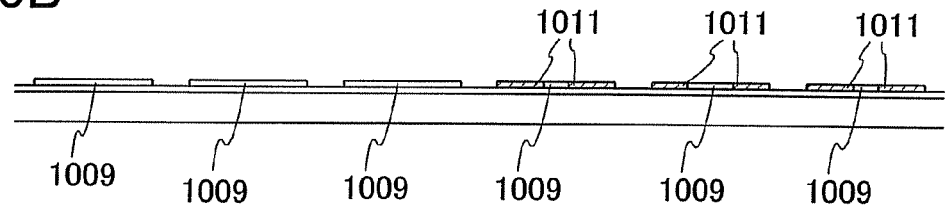

Next, as illustrated in FIG. 15B, the semiconductor layer 1009 is formed over part of the oxidized or nitrided base film 1008. Moreover, the impurity region 1011 is formed in part of the semiconductor layer 1009 using a resist mask or the like.

Figure 15C:
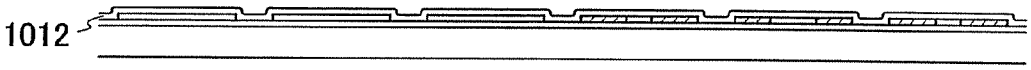

Then, as illustrated in FIG. 15C, the gate insulating film 1012 is formed so as to cover the semiconductor layer 1009 and the base film 1008.

Figure 15D:
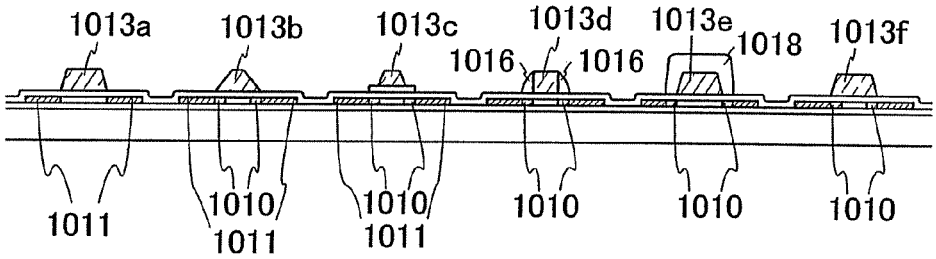

Next, as illustrated in FIG. 15D, the gate electrodes 1013*a* to 1013*f* are formed over part of the semiconductor layer 1009 with the gate insulating film 1012 interposed therebetween. At this time, the gate electrodes 1013*d* to 1013*f* are formed to have different shapes depending on usage of transistors. Gate electrode 1013*d* is provided with the sidewall 1016. Note that silicon oxide or silicon nitride can be used for the sidewall 1016. As a method of forming the sidewall 1016 on the side surface of the gate electrode 1013*d*, a method can be used, for example, in which the gate electrode 1013*d* is formed, a silicon oxide film or a silicon nitride film is formed, and after that, the silicon oxide film or the silicon nitride film is etched by anisotropic etching. Accordingly, the silicon oxide film or the silicon nitride film remains only on the side surface of the gate electrode 1013*d*, so that the sidewall 1016 can be formed on the side surface of the gate electrode 1013*d*. Further, the second impurity region 1010 is formed in some semiconductor layers 1009 by using the gate electrode, an additional resist mask, and the like.

Figure 15E:
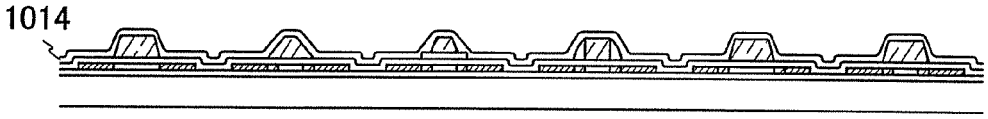

Then, as illustrated in FIG. 15E, the first insulating film 1014 is formed so as to cover the gate insulating film 1012 and the gate electrodes 1013*a* to 1013*f*. Note that the first insulating film 1014 can be formed by a sputtering method, a plasma CVD method, or the like. After that, the second insulating film 1015 and the wiring 1017 are formed, whereby the transistors having the structures as illustrated in FIG. 14 are formed.

As described above, by using the method of manufacturing transistors in this embodiment mode, transistors having different structures can be formed depending on usage. Accordingly, a display device can be easily manufactured.

Next, an example where a semiconductor substrate is used as a substrate for forming a transistor is described. Since a transistor formed using the semiconductor substrate has high mobility, the size of the transistor can be reduced. Accordingly, the number of transistors per unit area can be increased (the degree of integration can be improved), and the size of the substrate can be reduced as the degree of integration is increased in the case of employing the same circuit structure. Thus, manufacturing cost can be reduced. Further, since the circuit scale can be increased as the degree of integration is increased in the case of using substrates having the same size, the circuit can have more advanced functions while keeping manufacturing cost almost the same. Moreover, since the transistor has little variation in characteristics, manufacturing yield can be improved. Since the transistor has small operating voltage, power consumption can be reduced. Furthermore, since the transistor has high mobility, a high-speed operation can be obtained.

When a circuit which is formed by integrating transistors formed using a semiconductor substrate is mounted on a device in the form of an IC chip or the like, the device can have a variety of functions. For example, when a peripheral driver circuit (e.g., a data driver (a source driver), a scanning driver (a gate driver), a timing controller, an image processing circuit, an interface circuit, a power supply circuit, or an oscillation circuit) of a display device is formed by integrating the transistors formed using the semiconductor substrate, a small peripheral circuit which can be operated with low power consumption and at high speed can be formed at low cost in high yield. Note that a circuit which is formed by integrating the transistors formed using the semiconductor substrate may include a unipolar transistor. Accordingly, a manufacturing process can be simplified, so that manufacturing cost can be reduced.

A circuit which is formed by integrating the transistors formed using the semiconductor substrate may also be used for a display panel (a display portion), for example. More specifically, the circuit can be used for a reflective liquid crystal panel such as a liquid crystal on silicon (LCOS) device, a digital micromirror device (DMD) in which micromirrors are integrated, an EL panel, and the like. By forming such a display panel (display portion) using a semiconductor substrate, a small display panel (display portion) which can be operated with low power consumption and at high speed can be formed at low cost in high yield. Note that the display panel (the display portion) may be formed over an element having a function other than a function of driving the display panel (the display portion), such as a large-scale integration (LSI).

Next, a method of manufacturing transistors with the use of a semiconductor substrate is described with reference to FIGS. 16A to 16C and FIGS. 17A and 17D. FIGS. 16A to 16C and FIGS. 17A and 17D illustrate a method of manufacturing transistors using a semiconductor substrate.

Figure 16A:
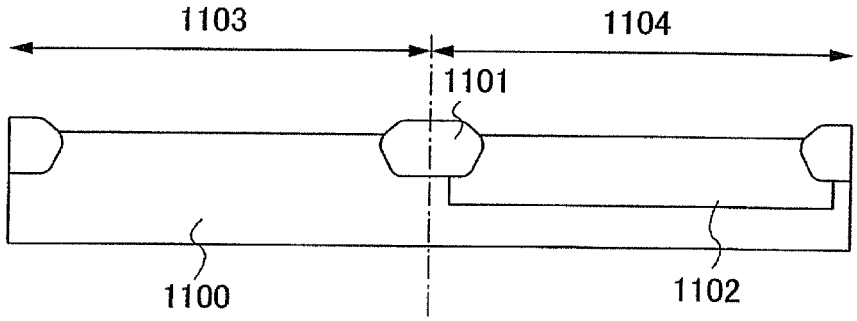
FIGS. 16A to 16C are schematic views illustrating a manufacturing method of a transistor applicable to a display device of the present invention in Embodiment Mode 4.

First, as illustrated in FIG. 16A, a first insulating film 1101 (also referred to as a field oxide film) is provided in a semiconductor substrate 1100, and a first element region 1103 and a second element region 1104 which are separated for each element are formed by using the insulating film 1101. Moreover, a p-well is formed in part of the semiconductor substrate 1100 of the second element region 1104.

Any substrate can be used as the semiconductor substrate 1100 as long as it is a semiconductor substrate. For example, a single crystal Si substrate having n-type or p-type conductivity, a compound semiconductor substrate (e.g., a GaAs substrate, an InP substrate, a GaN substrate, a SiC substrate, a sapphire substrate, or a ZnSe substrate), an SOI (silicon on insulator) substrate formed by a bonding method or a SIMOX (separation by implanted oxygen) method, or the like can be used.

Figure 16B:
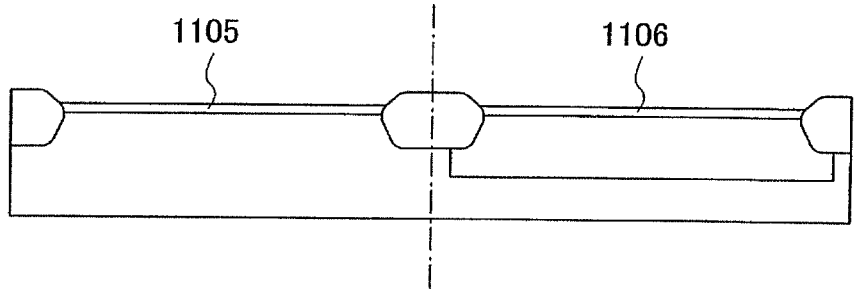

Next, as illustrated in FIG. 16B, a second insulating film 1105 is formed over the semiconductor substrate 1100 of the first element region 1103, and a third insulating film 1106 is formed over the semiconductor substrate 1100 of the second element region 1104.

For the second insulating film 1105 and the third insulating film 1106, a silicon oxide film formed by oxidizing surfaces of the first element region 1103 and the second element region 1104 provided in the semiconductor substrate 1100 by heat treatment can be used, for example.

Figure 16C:
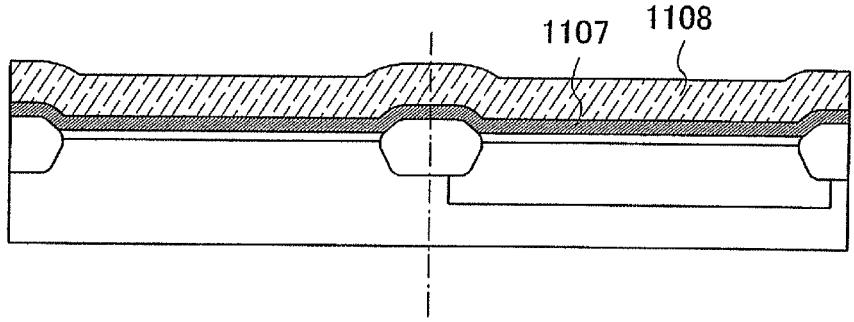

Then, as illustrated in FIG. 16C, a first conductive film 1107 and a second conductive film 1108 are formed over the semiconductor substrate 1100 and the first insulating film 1101.

Each of the first conductive film 1107 and the second conductive film 1108 can be formed using an element selected from tantalum, tungsten, titanium, molybdenum, aluminum, copper, chromium, niobium, or the like; or an alloy material or a compound material containing the above element as its main component. Alternatively, the first conductive film 1107 and the second conductive film 1108 can be formed using a metal nitride film obtained by nitridation of the above element; or a semiconductor material typified by polycrystalline silicon doped with an impurity element such as phosphorus or silicide in which a metal material is introduced.

Figure 17A:
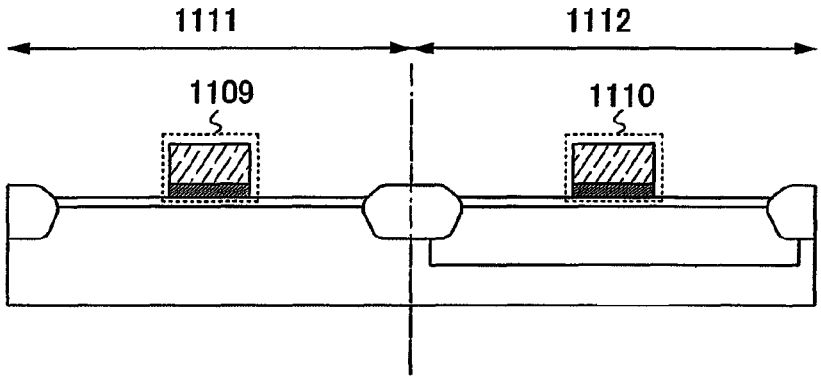
FIGS. 17A to 17D are schematic views illustrating a manufacturing method of a transistor applicable to a display device of the present invention in Embodiment Mode 4.
Figure 17B:
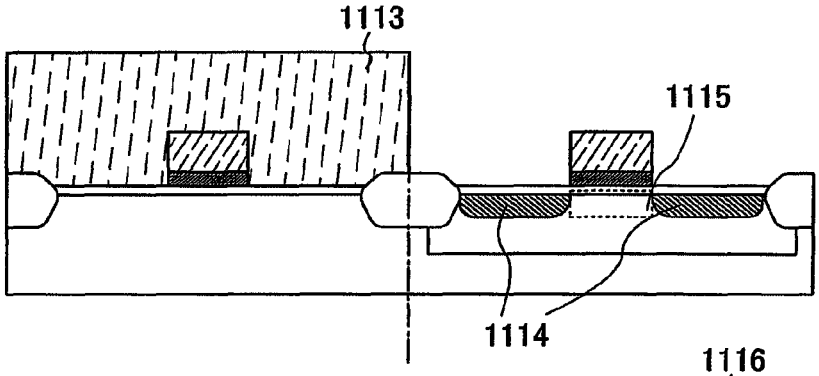

Next, as illustrated in FIG. 17A, a first gate electrode 1109 and a second gate electrode 1110 are formed over part of the second insulating film 1105 and part of the third insulating film 1106. Further, as illustrated in FIG. 17B, a resist mask 1113 is formed in the first element region 1103 so as to cover the first gate electrode 1109, the first insulating film 1101, and the second insulating film 1105. Then, an impurity is added using the resist mask 1113 and the second gate electrode 1110 as masks, so that impurity regions 1114 are formed. Moreover, part of the semiconductor substrate 1100 located below the second gate electrode 1110 serves as a channel region 1115.

Figure 17C:
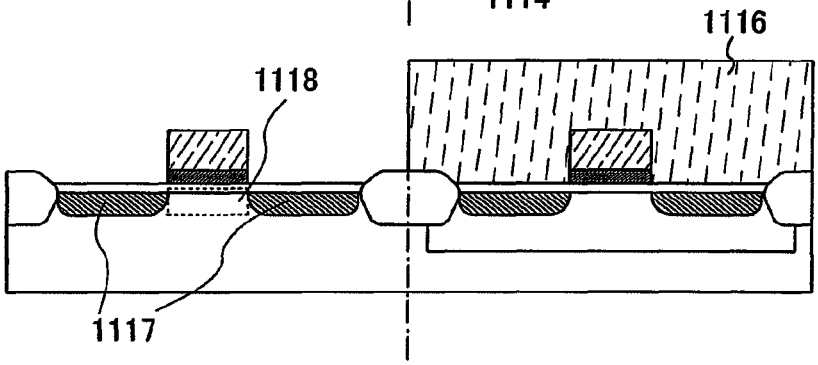

Next, as illustrated in FIG. 17C, in the second element region 1104, a resist mask 1116 is formed over the second gate electrode 1110, the first insulating film 1101, and the third insulating film 1106. Then, an impurity is added using the resist mask 1116 and the first gate electrode 1109 as masks, so that impurity regions 1117 are formed. Moreover, part of the semiconductor substrate 1100 located below the first gate electrode 1109 serves as a channel region 1118.

Figure 17D:
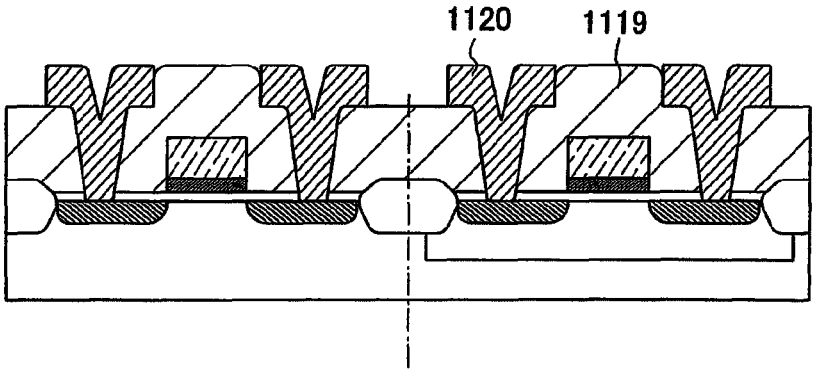

Next, as illustrated in FIG. 17D, a fourth insulating film 1119 is formed so as to cover the first gate electrode 1109, the second gate electrode 1110, the first insulating film 1101, the second insulating film 1105, and the third insulating film 1106. Then, wirings 1120 are formed so as to be in contact with the impurity region 1114 or the impurity region 1117 through the fourth insulating film 1119, the second insulating film 1105, and the third insulating film 1106.

The fourth insulating film 1119 can be provided with a single-layer structure or a stacked-layer structure of any of an insulating film containing oxygen or nitrogen such as silicon oxide, silicon nitride, silicon oxynitride, or silicon nitride oxide; a film containing carbon, such as diamond-like carbon (DLC); an organic material such as epoxy, polyimide, polyamide, polyvinyl phenol, benzocyclobutene, or acrylic; or a siloxane material such as a siloxane resin by a CVD method, a sputtering method, or the like. A siloxane material corresponds to a material having Si—O—Si bonds. Siloxane has a skeleton structure with a bond of silicon and oxygen. As a substituent, an organic group containing at least hydrogen (such as an alkyl group or aromatic hydrocarbon) is used. A fluoro group may be included in the organic group.

The wiring 1120 is formed to have a single-layer structure or a stacked-layer structure of an element selected from aluminum, tungsten, titanium, tantalum, molybdenum, nickel, platinum, copper, gold, silver, manganese, neodymium, carbon, or silicon; or an alloy material or a compound material containing the above element as its main component by a CVD method, a sputtering method, or the like. An alloy material containing aluminum as its main component corresponds to, for example, a material which contains aluminum as its main component and also contains nickel, or a material which contains aluminum as its main component and also contains nickel and at least one of carbon and silicon. The wiring 1120 preferably has a stacked-layer structure of a first barrier film, an aluminum-silicon film, and a second barrier film or a stacked-layer structure of a first barrier film, an aluminum-silicon film, a titanium nitride film, and a second barrier film. Note that the barrier film corresponds to a thin film formed of titanium, titanium nitride, molybdenum, or molybdenum nitride. Aluminum and aluminum silicon are suitable materials for forming the wiring 1120 because they have high resistance values and are inexpensive. For example, when upper and lower barrier layers are provided, generation of hillocks of aluminum or aluminum silicon can be prevented. For example, when a barrier film is formed of titanium which is an element having a high reducing property, even if a thin natural oxide film is formed on a crystalline semiconductor film, the natural oxide film is reduced. Thus, the wiring 1120 can be electrically and physically connected to the crystalline semiconductor film in favorable condition.

Note that the structure of the transistor is not limited to that illustrated in the drawings. For example, the transistor can have a structure such as an inverted staggered structure or a FinFET structure. A FinFET structure is preferable because it can suppress short channel effect due to reduction in transistor size.

The structures and the manufacturing method of transistors have been described above. Here, a wiring, an electrode, a conductive layer, a conductive film, a terminal, a via, a plug, and the like are preferably formed of one or more elements selected from aluminum, tantalum, titanium, molybdenum, tungsten, neodymium, chromium, nickel, platinum, gold, silver, copper, magnesium, scandium, cobalt, zinc, niobium, silicon, phosphorus, boron, arsenic, gallium, indium, or tin; or a compound or an alloy material containing one or more of the above elements (e.g., indium tin oxide (ITO), indium zinc oxide (IZO), indium tin oxide containing silicon oxide (ITSO), zinc oxide, tin oxide, cadmium tin oxide, aluminum neodymium, magnesium silver, or molybdenum-niobium); a substance in which these compounds are combined; or the like. Alternatively, they are preferably formed to contain a compound (silicide) of silicon and one or more of the above elements (e.g., aluminum silicon, molybdenum silicon, or nickel silicide), or a compound of nitrogen and one or more of the above elements (e.g., titanium nitride, tantalum nitride, or molybdenum nitride).

Note that silicon may contain an n-type impurity (such as phosphorus) or a p-type impurity (such as boron). When silicon contains the impurities, the conductivity of the silicon is increased, or the silicon has characteristics similar to a general conductor Accordingly, such silicon can be used as a wiring, an electrode, or the like.

Furthermore, silicon with various levels of crystallinity, such as single crystalline silicon, polycrystalline silicon, or microcrystalline (microcrystal) silicon can be used. Alternatively, silicon having no crystallinity, such as amorphous silicon, can be used. By using single crystalline silicon or polycrystalline silicon for a wiring, an electrode, a conductive layer, a conductive film, a terminal, or the like, their resistance can be reduced. By using amorphous silicon or microcrystalline silicon for a wiring or the like, they can be formed by a simple process.

Since ITO, IZO, ITSO, zinc oxide, silicon, tin oxide, and cadmium tin oxide have light-transmitting properties, they can be used for a portion which transmits light. For example, they can be used for a pixel electrode or a common electrode.

IZO is preferable because it is easily etched and processed. In etching IZO, a residue is hardly left. Accordingly, when IZO is used for a pixel electrode, defects (such as short circuit or orientation disorder) of a liquid crystal element or a light-emitting element can be reduced.

Note that a wiring, an electrode, a conductive layer, a conductive film, a terminal, a via, a plug, or the like may have a single-layer structure or a multi-layer structure. By employing a single-layer structure, each manufacturing process of a wiring, an electrode, a conductive layer, a conductive film, a terminal, or the like can be simplified, processing days for them can be reduced, and manufacturing cost can be reduced. Alternatively, by employing a multi-layer structure, a wiring, an electrode, and the like with high quality can be formed while an advantage of each material is utilized and a disadvantage thereof is reduced. For example, when a low-resistant material (e.g., aluminum) is included in a multi-layer structure, reduction in resistance of a wiring can be obtained. As another example, when a stacked-layer structure in which a low heat-resistant material is interposed between high heat-resistant materials is employed, heat resistance of a wiring, an electrode, and the like can be increased, utilizing advantages of the low heat-resistance material. For example, it is preferable to employ a stacked-layer structure in which a layer containing aluminum is interposed between layers containing molybdenum, titanium, neodymium, or the like.

When wirings, electrodes, or the like are in direct contact with each other, they adversely affect each other in some cases. For example, one wiring or one electrode is mixed into a material of another wiring or another electrode and changes its properties, and thus, an intended function cannot be obtained in some cases. As another example, when a high-resistant portion is formed, a problem may occur so that it cannot be normally formed. In such cases, a reactive material is preferably interposed by or covered with a non-reactive material in a stacked-layer structure. For example, when ITO and aluminum are connected, titanium, molybdenum, or an alloy of neodymium is preferably interposed between ITO and aluminum. As another example, when silicon and aluminum are connected, titanium, molybdenum, or an alloy of neodymium is preferably interposed between silicon and aluminum.

The term "wiring" indicates a portion including a conductor. A wiring may be a linear shape or may be short without a linear shape. Therefore, an electrode is included in a wiring.

Note that a carbon nanotube may be used for a wiring, an electrode, a conductive layer, a conductive film, a terminal, a via, a plug, or the like. Since a carbon nanotube has a light-transmitting property, it can be used for a portion which transmits light. For example, a carbon nanotube can be used for a pixel electrode or a common electrode.

As described above, the transistor in the display device of the present invention can be formed by the method of manufacturing transistors in this embodiment mode. Further, the display device of the present invention can be formed by combining the transistor of the present invention with another wiring, circuit, element, or the like.

Note that this embodiment mode can be combined with other embodiment modes as appropriate.

Embodiment Mode 5

In this embodiment mode, examples of electronic devices provided with the display device of the present invention are described.

Figure 18:
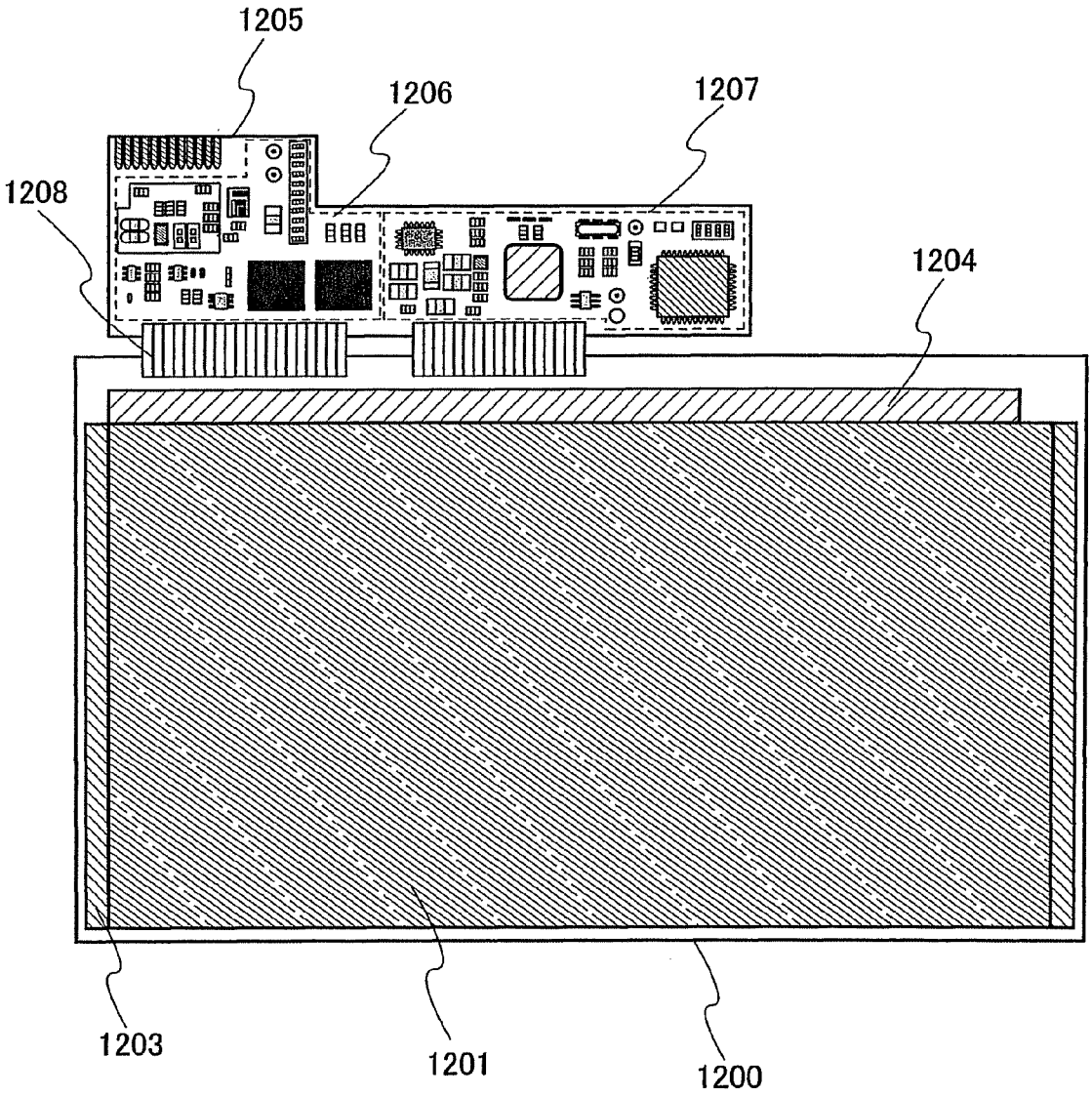
FIG. 18 illustrates an electronic device including a display device of the present invention in Embodiment Mode 5.

An example of a display device in this embodiment mode is described with reference to FIG. 18. FIG. 18 is a schematic view illustrating a display device in this embodiment mode.

As illustrated in FIG. 18, for example, the display device in this embodiment mode includes a display panel (a display portion) 1200 and a display panel module combined with a circuit board 1205. The display panel (the display portion) 1200 includes a pixel portion 1201, a scanning line driver circuit 1203, and a signal line driver circuit 1204. The circuit board 1205 includes a control circuit 1206 and a signal dividing circuit 1207, for example. The display panel (the display portion) 1200 and the circuit board 1205 are connected to each other by a connection wiring 1208. An FPC or the like can be used as the connection wiring.

Figure 19:
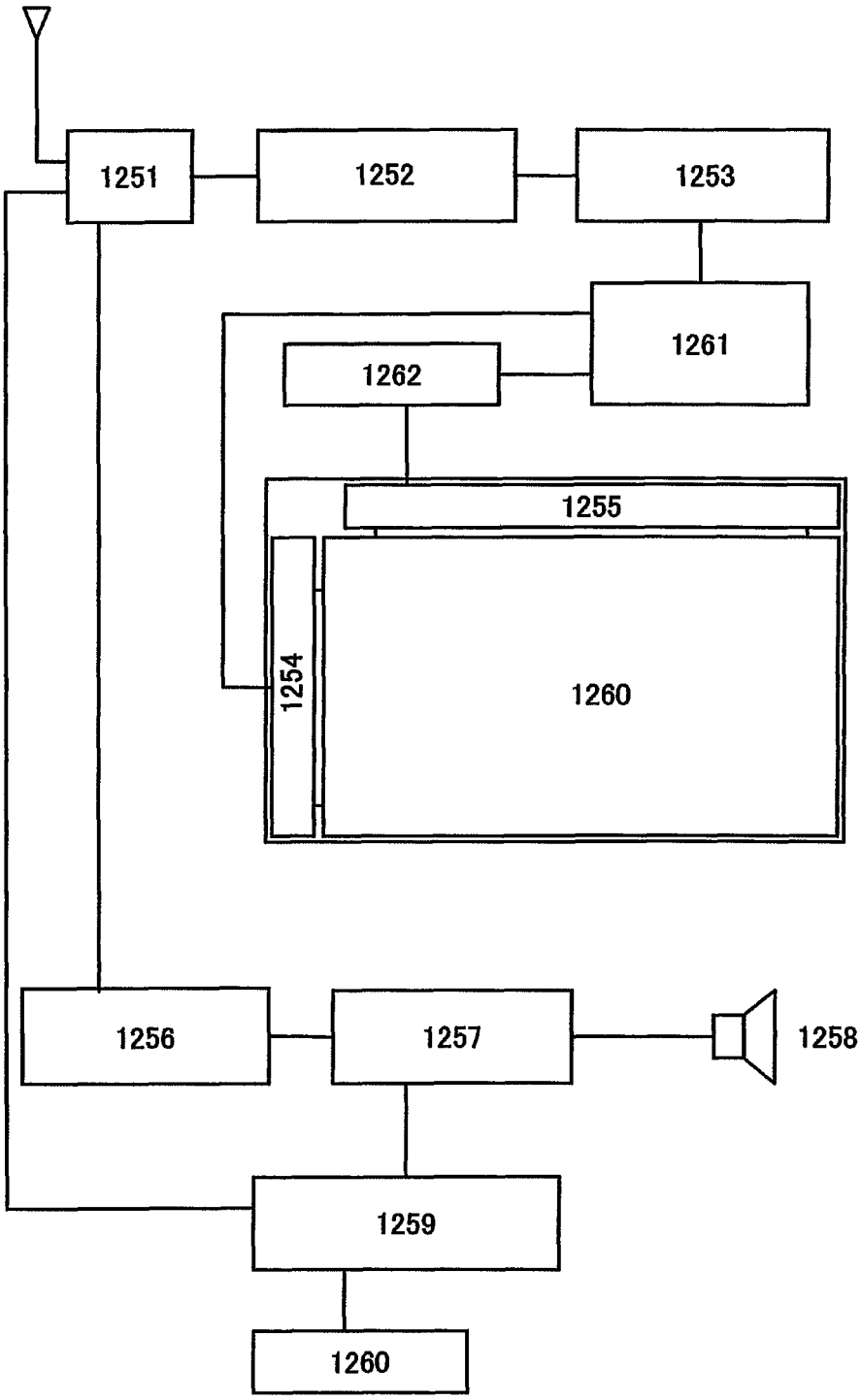
FIG. 19 illustrates an electronic device including a display device of the present invention in Embodiment Mode 5.

Next, a structure of an example of the display device in this embodiment mode is described with reference to FIG. 19. FIG. 19 is a block diagram illustrating a structure of an example of the display device in this embodiment mode.

As illustrated in FIG. 19, a tuner 1251 receives a video signal and an audio signal. The video signals are processed by an video signal amplifier circuit 1252; a video signal processing circuit 1253 which converts a signal outputted from the video signal amplifier circuit 1252 into a color signal corresponding to each color of red, green, and blue; and a control circuit 1261 which converts the video signal into the input specification of a driver circuit. The control circuit 1261 outputs a signal to each of a scanning line driver circuit 1254 and a signal line driver circuit 1255. A display panel (a display portion) 1260 is driven by the scanning line driver circuit 1254 and the signal line driver circuit 1255. When digital driving is performed, a structure may be employed in which a signal dividing circuit 1262 is provided on the signal line side and an input digital signal is divided into m signals (m is a positive integer) to be supplied.

Among the signals received by the tuner 1251, an audio signal is transmitted to an audio signal amplifier circuit 1256, and an output thereof is supplied to a speaker 1258 through an audio signal processing circuit 1257. A control circuit 1259 receives control information on receiving station (receiving frequency) and volume from an input portion 1260 and transmits signals to the tuner 1251 or the audio signal processing circuit 1257.

Figure 20A:
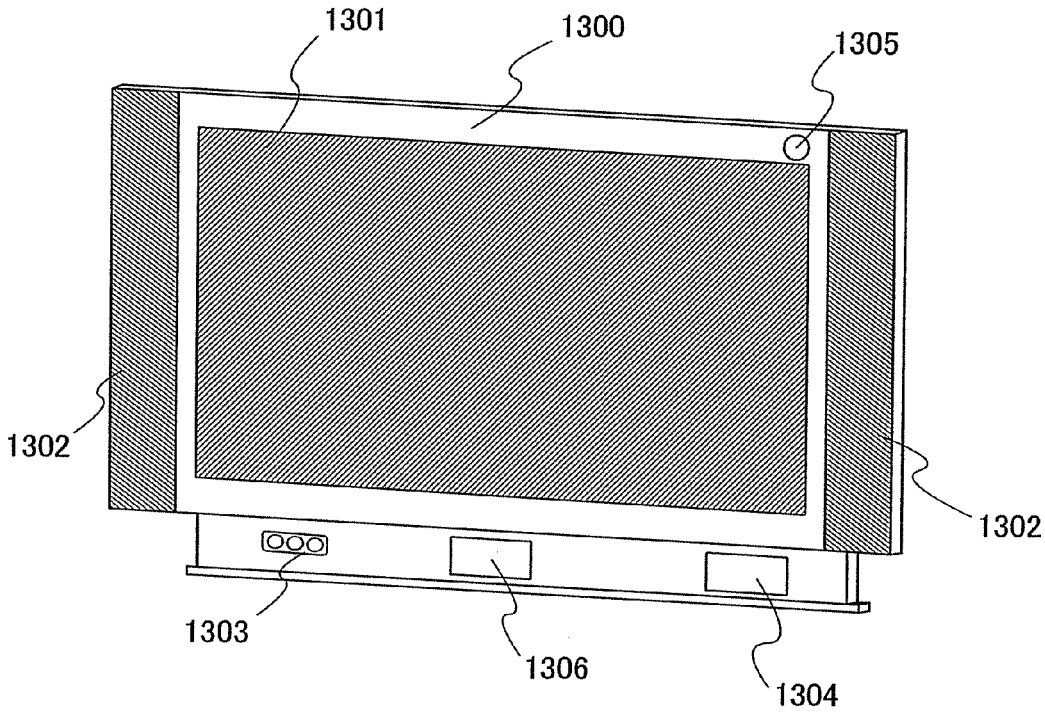
FIGS. 20A and 20B each illustrate an electronic device including a display device of the present invention in Embodiment Mode 5.
Figure 20B:
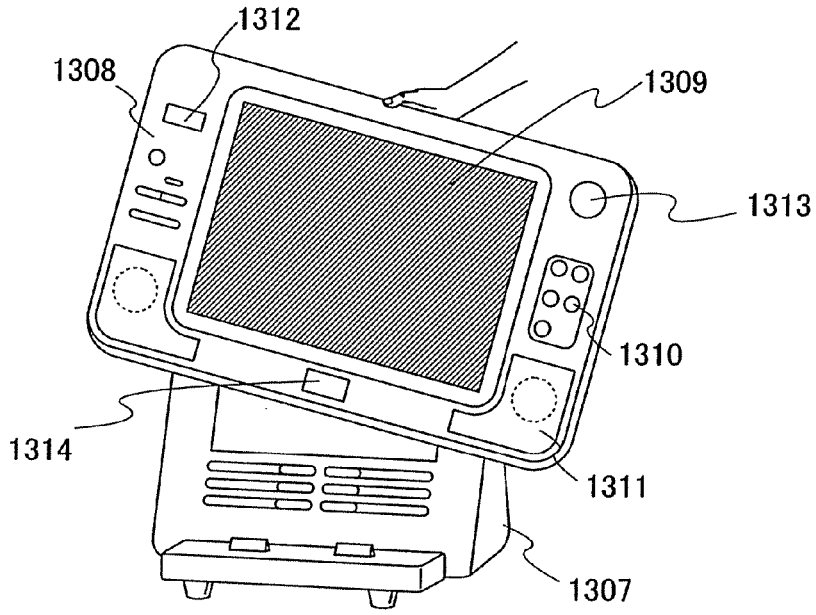

Next, another example of the display device in this embodiment mode is described with reference to FIGS. 20A and 20B. FIGS. 20A and 20B are schematic views each illustrating another example of the display device in this embodiment mode.

As illustrated in FIG. 20A, a display screen 1301 incorporated in a housing 1300 is formed using a display panel (display portion) module. Note that speakers 1302, input means (an operation key 1303, a connection terminal 1304, a sensor 1305 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray), and a microphone 1306), and the like may be provided as appropriate.

FIG. 20B illustrates a television receiver including a display which can be carried wirelessly. The television receiver is provided with a display portion 1309, a speaker portion 1311, input means (an operation key 1310, a connection terminal 1312, a sensor 1313 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray), and a microphone 1314), and the like as appropriate. A battery and a signal receiver are incorporated in a housing 1308. The display portion 1309, the speaker portion 1311, the sensor 1313, and the microphone 1314 are driven by the battery. The battery can be repeatedly charged by a charger 1307. The charger 1307 can transmit and receive a video signal and transmit the video signal to the signal receiver of the display. The device illustrated in FIG. 20B is controlled by the operation key 1310. Alternatively, the device illustrated in FIG.

20B can transmit a signal to the charger 1307 by operating the operation key 1310. That is, the device may be an image and audio interactive communication device. Further alternatively, the device illustrated in FIG. 20B can transmit a signal to the charger 1307 by operating the operation key 1310 and can control communication of another electronic device by making another electronic device receive a signal that the charger 1307 can transmit. That is, the device may be a general-purpose remote control device. Note that the contents (or a part thereof) described in each drawing of this embodiment mode can be applied to the display portion 1309.

Figure 21:
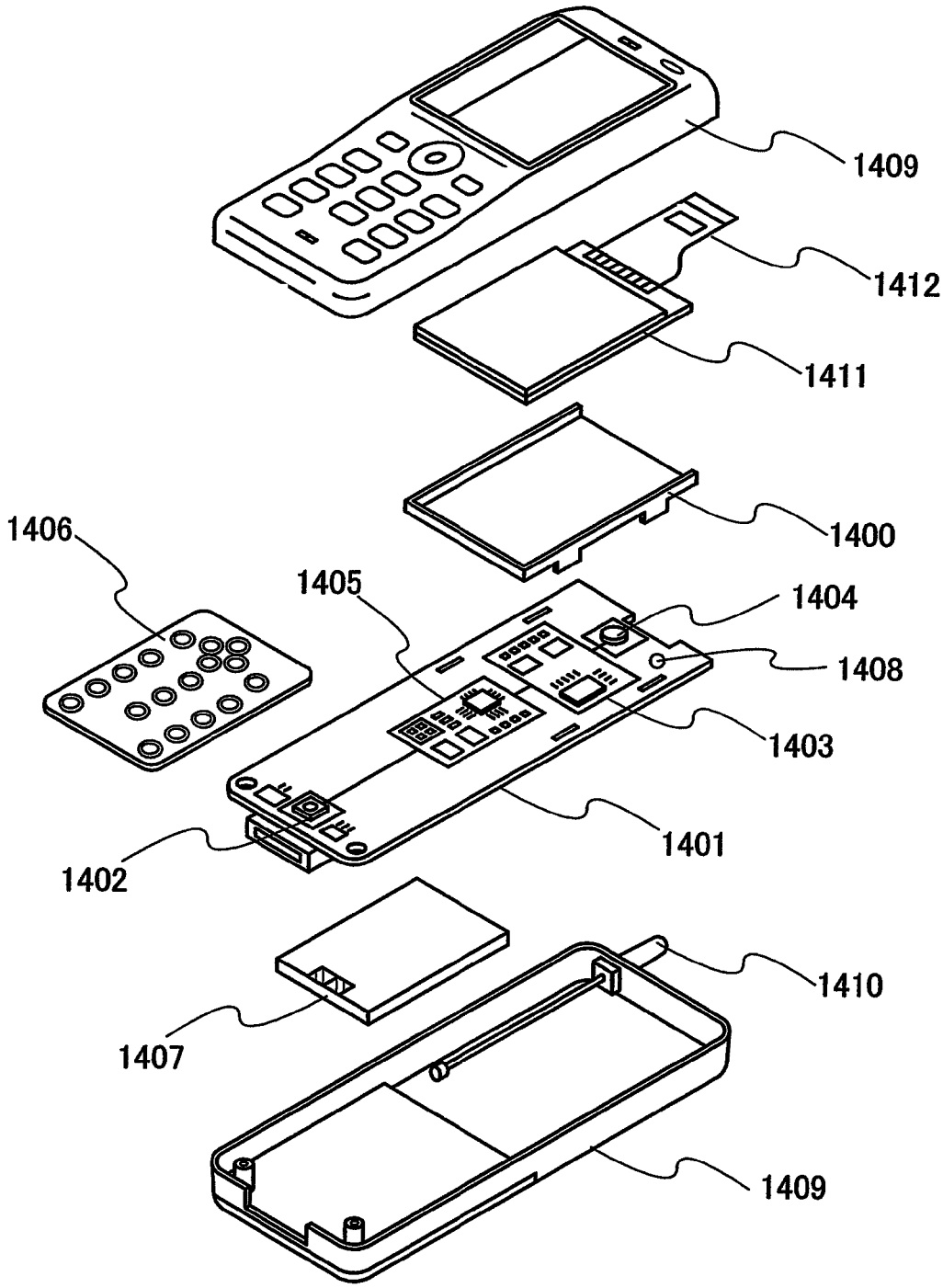
FIG. 21 illustrates an electronic device including a display device of the present invention in Embodiment Mode 5.

Next, as an example of an electronic device including the display device in this embodiment mode, a mobile phone is described with reference to FIG. 21. FIG. 21 is a schematic view illustrating a structure of a mobile phone in this embodiment mode.

As illustrated in FIG. 21, a display panel (a display portion) 1411 is detachably incorporated in a housing 1400. The shape and the size of the housing 1400 can be changed as appropriate in accordance with the size of the display panel (the display portion) 1411. The housing 1400 to which the display panel (the display portion) 1411 is fixed is fitted in a printed wiring board 1401 to be assembled as a module.

The display panel (the display portion) 1411 is connected to the printed wiring board 1401 through an FPC 1412. The printed wiring board 1401 is provided with a speaker 1404, a microphone 1402, a transmitting/receiving circuit 1403, a signal processing circuit 1405 including a CPU, a controller, and the like, and a sensor 1408 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray). Such a module, an operation key 1406, a battery 1407, and an antenna 1410 are combined and stored in a housing 1409. A pixel portion of the display panel (the display portion) 1411 is provided to be seen from an opening window formed in the housing 1409.

In the display panel (the display portion) 1411, the pixel portion and part of peripheral driver circuits (a driver circuit having low operation frequency among a plurality of driver circuits) may be formed over the same substrate by using transistors, and another part of the peripheral driver circuits (a driver circuit having high operation frequency among the plurality of driver circuits) may be formed over an IC chip. Then, the IC chip may be mounted on the display panel (the display portion) 1411 by COG (chip on glass). Alternatively, the IC chip may be connected to a glass substrate by using TAB (tape automated bonding) or a printed wiring board. With such a structure, power consumption of a display device can be reduced, and operation time of the mobile phone per charge can be extended. Further, reduction in cost of the mobile phone can be realized.

The mobile phone illustrated in FIG. 21 has various functions such as, but not limited to, a function of displaying various kinds of information (e.g., a still image, a moving image, and a text image); a function of displaying a calendar, a date, the time, and the like on a display portion; a function of operating or editing the information displayed on the display portion; a function of controlling processing by various kinds of software (programs); a function of wireless communication; a function of communicating with another mobile phone, a fixed phone, or an audio communication device by using the wireless communication function; a function of connecting with various computer networks by using the wireless communication function; a function of transmitting or receiving various kinds of data by using the wireless communication function; a function of operating a vibrator in accordance with incoming call, reception of data, or an alarm; and a function of generating a sound in accordance with incoming call, reception of data, or an alarm.

Figure 22A:
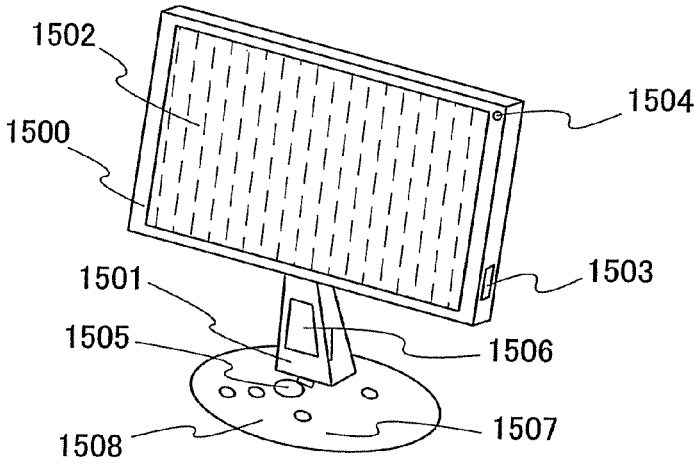
FIGS. 22A to 22C each illustrate an electronic device including a display device of the present invention in Embodiment Mode 5.

FIG. 22A illustrates a display, which includes a housing 1500, a support base 1501, a display portion 1502, a speaker 1506, an LED lamp 1508, input means (a connection terminal 1503, a sensor 1504 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray), a microphone 1505, and an operation key 1507), and the like. The display in FIG. 22A can have various functions such as, but not limited to, a function of displaying various kinds of information (e.g., a still image, a moving image, and a text image) on the display portion.

Figure 22B:
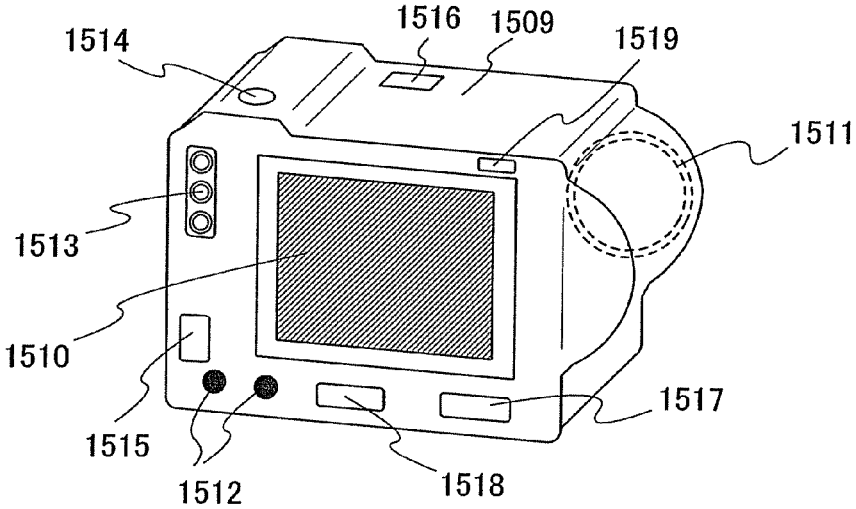

FIG. 22B illustrates a camera, which includes a main body 1509, a display portion 1510, a shutter button 1514, a speaker 1517, an LED lamp 1519, input means (an image receiving portion 1511, operation keys 1512, an external connection port 1513, a connection terminal 1515, a sensor 1516 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray), and a microphone 1518), and the like. The camera in FIG. 22B can have various functions such as, but not limited to, a function of photographing a still image and a moving image; a function of automatically adjusting the photographed image (the still image or the moving image); a function of storing the photographed image in a recording medium (provided externally or incorporated in the camera); and a function of displaying the photographed image on the display portion.

Figure 22C:
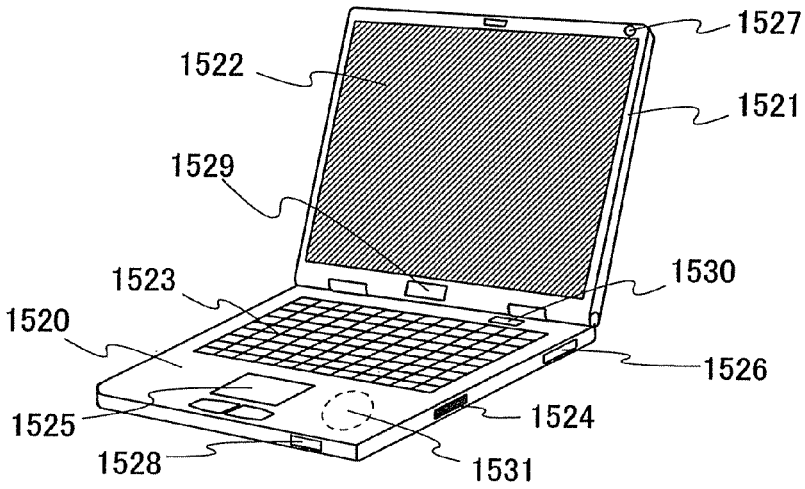

FIG. 22C illustrates a computer, which includes a main body 1520, a housing 1521, a display portion 1522, a speaker 1529, an LED lamp 1530, a reader/writer 1531, input means (a keyboard 1523, an external connection port 1524, a pointing device 1525, a connection terminal 1526, a sensor 1527 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray), and a microphone 1528), and the like. The computer in FIG. 22C can have various functions such as, but not limited to, a function of displaying various kinds of information (e.g., a still image, a moving image, and a text image) on the display portion; a function of controlling processing by various kinds of software (programs); a communication function such as wireless communication or wire communication; a function of connecting with various computer networks by using the communication function; and a function of transmitting or receiving various kinds of data by using the communication function.

Figure 23A:
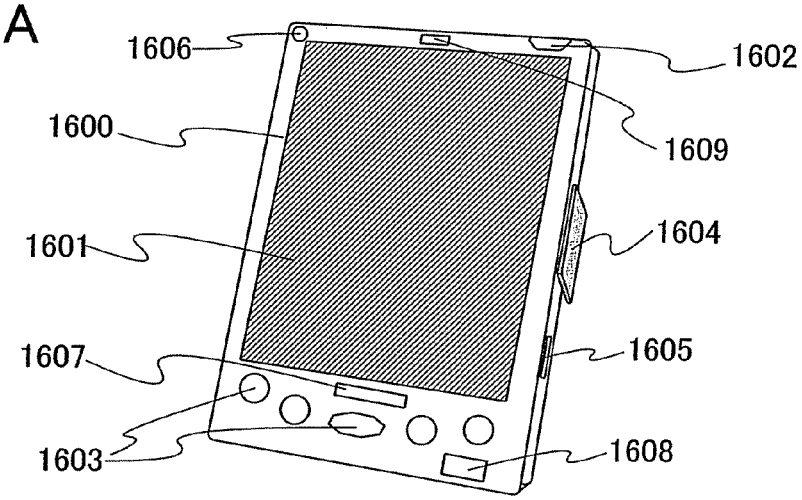
FIGS. 23A to 23C each illustrate an electronic device including a display device of the present invention in Embodiment Mode 5.

FIG. 23A illustrates a mobile computer, which includes a main body 1600, a display portion 1601, a switch 1602, a speaker 1608, an LED lamp 1609, input means (operation keys 1603, an infrared port 1604, a connection terminal 1605, a sensor 1606 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray), and a microphone 1607), and the like. The mobile computer in FIG. 23A can have various functions such as, but not limited to, a function of displaying various kinds of information (e.g., a still image, a moving image, and a text image) on the display portion; a touch panel function provided on the display portion; a function of displaying a calendar, a date, the time, and the like on the display portion; a function of controlling processing by various kinds of software (programs); a function of wireless communication; a function of connecting with various computer networks by using the wireless communication function; and a function of transmitting or receiving various kinds of data by using the wireless communication function.

Figure 23B:
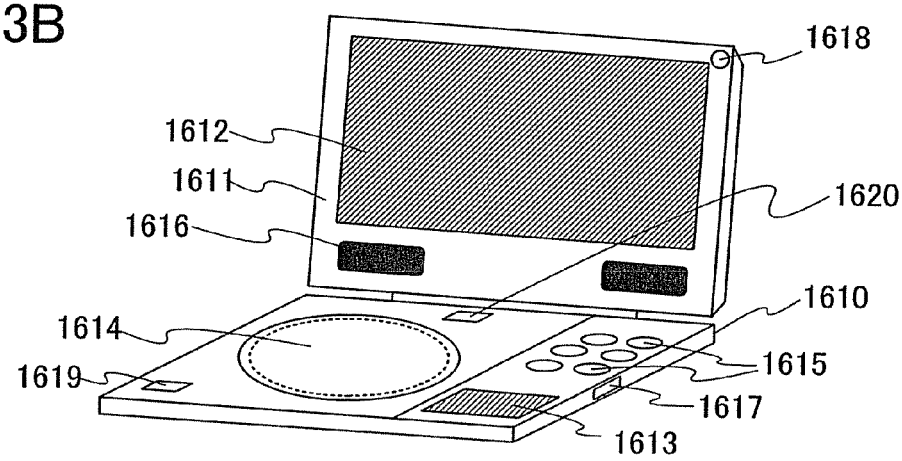

FIG. 23B illustrates a portable image reproducing device having a recording medium (e.g., a DVD reproducing device), which includes a main body 1610, a housing 1611, a display portion A 1612, a display portion B 1613, a speaker portion 1616, an LED lamp 1620, input means (a recording medium (e.g., DVD) reading portion 1614, operation keys 1615, a connection terminal 1617, a sensor 1618 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray), and a microphone 1619), and the like. The display portion A 1612 can mainly display image information, and the display portion B 9813 can mainly display text information.

Figure 23C:
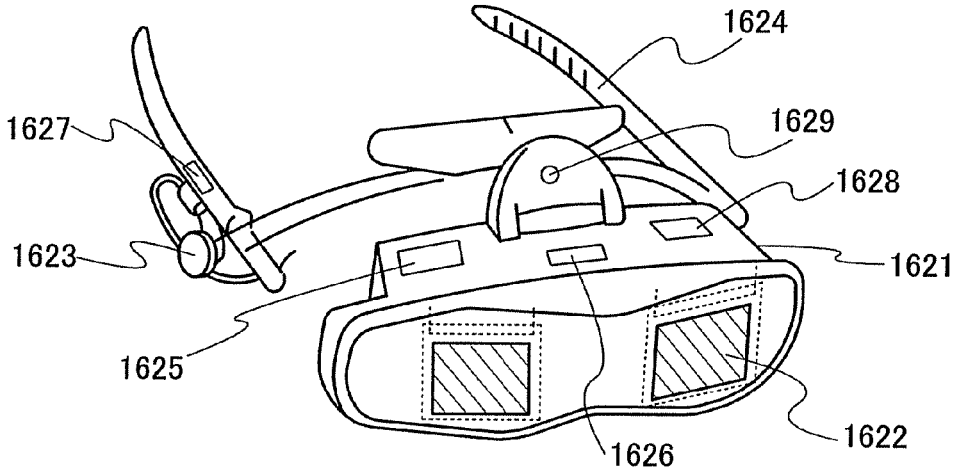
Figure 24:
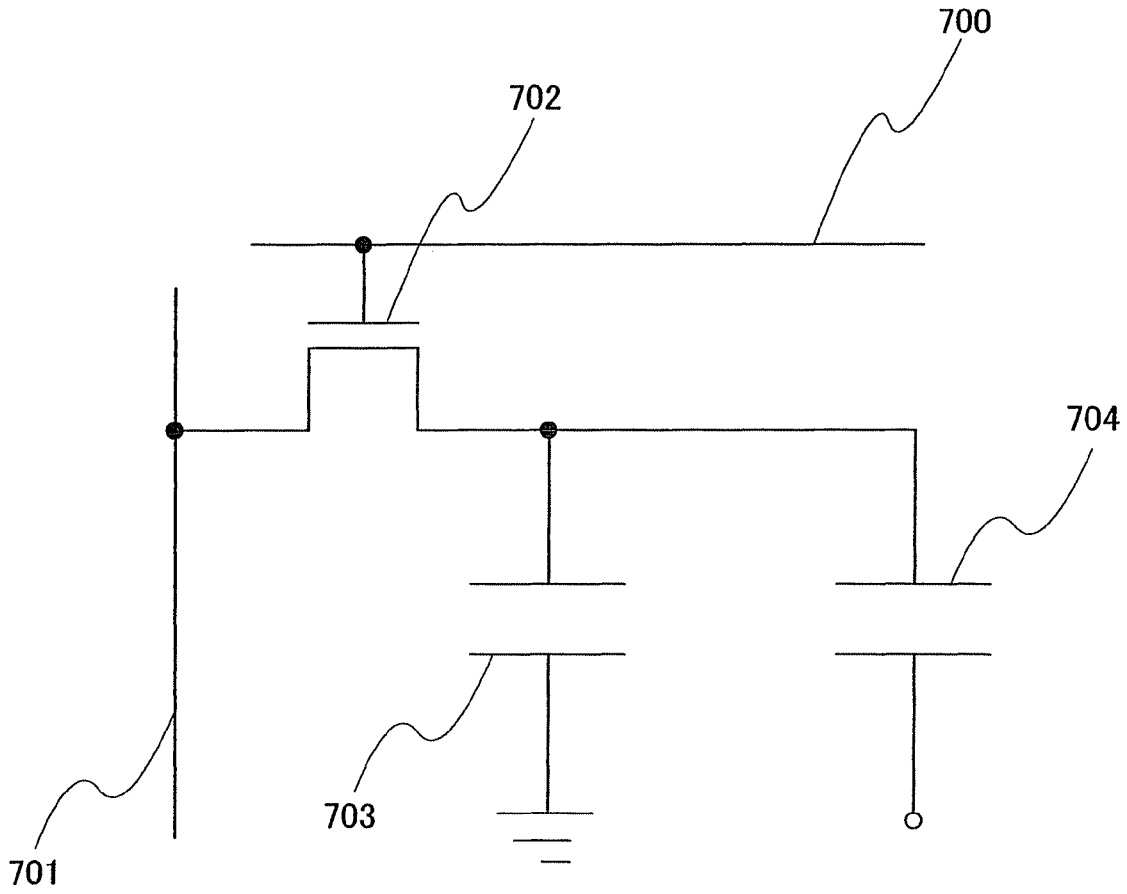
FIG. 24 is a circuit diagram illustrating a structure of a conventional display device.

FIG. 23C illustrates a goggle-type display, which includes a main body 1621, a display portion 1622, an earphone 1623, a support portion 1624, an LED lamp 1629, a speaker 1628, input means (a connection terminal 1625, a sensor 1626 (having a function of measuring force, displacement, position, speed, acceleration, angular velocity, rotation number, distance, light, liquid, magnetism, temperature, chemical substance, sound, time, hardness, electric field, current, voltage, electric power, radial ray, flow rate, humidity, gradient, vibration, smell, or infrared ray), and a microphone 1627), and the like. The goggle-type display in FIG. 23C can have various functions such as, but not limited to, a function of displaying an image (e.g., a still image, a moving image, and a text image) obtained from the outside of the display portion.

As illustrated in FIG. 18, FIG. 19, FIGS. 20A and 20B, FIG. 21, FIGS. 22A to 22C, and FIGS. 23A to 23C, the electronic device includes the display portion for displaying some kind of information.

As described above, the display device of the present invention can be applied to a variety of electronic devices, whereby a highly reliable electronic device can be provided.

Note that this embodiment mode can be combined with other embodiment modes as appropriate.

This application is based on Japanese Patent Application serial No. 2007-274141 filed with Japan Patent Office on Oct. 22, 2007, the entire contents of which are hereby incorporated by reference.

What is claimed is:

1. A display device comprising:

a plurality of signal lines;

a plurality of scanning lines;

a plurality of electric charge supply lines;

a plurality of pixels, each of the pixels including a first transistor, a first capacitor, a second capacitor, and a second transistor;

wherein a gate terminal of the first transistor and a gate terminal of the second transistor are electrically connected to one of the scanning lines, and one of a source terminal and a drain terminal of the first transistor is electrically connected to one of the signal lines, wherein a first electrode of the first capacitor is electrically connected to the other of the source terminal and the drain terminal of the first transistor, wherein a first electrode of the second capacitor is electrically connected to the first electrode of the first capacitor, wherein one of a source terminal and a drain terminal of the second transistor is electrically connected to a second electrode of the first capacitor, and the other of the source terminal and the drain terminal of the second transistor is electrically connected to one of the electric charge supply lines, and wherein the second electrode of the first capacitor is electrically floating whenever the first transistor is in an off state.

2. An electronic device including the display device according to claim 1 in a display portion.

3. A display device according to claim 1, wherein the second capacitor comprises liquid crystal molecules.

4. A display device according to claim 1, wherein the electric charge supply lines are grounded.

5. A display device according to claim 1, wherein a potential difference between a potential of the one of the signal lines and a potential of the one of the electric charge supply lines is applied to the first capacitor.

6. A display device according to claim 1, wherein voltage of the first capacitor at the time of writing is set higher than that of the second capacitor by adjustment of a potential of the one of the electric charge supply lines.

7. A display device comprising:

a pixel portion including a plurality of pixels, each of the pixels including a first transistor, a first capacitor, a second capacitor, and a second transistor;

a plurality of signal lines;

a plurality of scanning lines;

a plurality of electric charge supply lines;

a scanning line driver circuit electrically connected to the scanning lines;

a signal line driver circuit electrically connected to the signal lines; and a control circuit which is electrically connected to the scanning line driver circuit and the signal line driver circuit and outputs a control signal to the scanning line driver circuit and the signal line driver circuit, wherein a gate terminal of the first transistor and a gate terminal of the second transistor are electrically connected to one of the scanning lines, and one of a source terminal and a drain terminal of the first transistor is electrically connected to one of the signal lines, wherein a first electrode of the first capacitor is electrically connected to the other of the source terminal and the drain terminal of the first transistor, wherein a first electrode of the second capacitor is electrically connected to the first electrode of the first capacitor, wherein one of a source terminal and a drain terminal of the second transistor is electrically connected to a second electrode of the first capacitor, and the other of the source terminal and the drain terminal of the second transistor is electrically connected to one of the electric charge supply lines, and wherein the second electrode of the first capacitor is electrically floating whenever the first transistor is in an off state.

8. An electronic device including the display device according to claim 7 in a display portion.

9. A display device according to claim 7, wherein the second capacitor comprises liquid crystal molecules.

10. A display device according to claim 7, wherein the one of the electric charge supply lines is grounded.

11. A display device according to claim 7, wherein a potential difference between a potential of the one of the signal lines and a potential of the one of the electric charge supply lines is applied to the first capacitor.

12. A display device according to claim 7, wherein voltage of the first capacitor at the time of writing is set higher than that of the second capacitor by adjustment of a potential of the one of the electric charge supply lines.

* * * * *